US007448710B2

(12) United States Patent
Kusunoki

(10) Patent No.: US 7,448,710 B2
(45) Date of Patent: Nov. 11, 2008

(54) LIQUID DROPLET EJECTION HEAD AND IMAGE FORMING APPARATUS

(75) Inventor: Naoki Kusunoki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 378 days.

(21) Appl. No.: 11/180,704

(22) Filed: Jul. 14, 2005

(65) Prior Publication Data

US 2006/0012622 A1 Jan. 19, 2006

(30) Foreign Application Priority Data

Jul. 16, 2004 (JP) ..... 2004-210593

(51) Int. Cl.
*B41J 29/38* (2006.01)
*B41J 2/045* (2006.01)

(52) U.S. Cl. ..... 347/12; 347/71

(58) Field of Classification Search ..... 347/43, 347/42, 71, 95

See application file for complete search history.

(56) References Cited

U.S. PATENT DOCUMENTS

| | | | | |
|---|---|---|---|---|
| 6,070,972 | A * | 6/2000 | Thiel | 347/71 |
| 6,179,412 | B1 | 1/2001 | Ishinaga et al. | |
| 6,371,603 | B1 | 4/2002 | Seto | |
| 6,375,819 | B1 * | 4/2002 | Li et al. | 204/455 |
| 6,921,151 | B2 * | 7/2005 | Matsuo et al. | 347/42 |
| 2002/0018095 | A1 | 2/2002 | Nakamura et al. | |
| 2002/0024557 | A1 * | 2/2002 | Matsumoto et al. | 347/42 |

FOREIGN PATENT DOCUMENTS

| | | | |
|---|---|---|---|
| JP | 2-8059 | A | 1/1990 |
| JP | 4-329151 | A | 11/1992 |
| JP | 5-338173 | A | 12/1993 |
| JP | 8-52867 | A | 2/1996 |
| JP | 9-136417 | A | 5/1997 |
| JP | 10-24564 | A | 1/1998 |

(Continued)

*Primary Examiner*—Matthew Luu
*Assistant Examiner*—Lisa M Solomon
(74) *Attorney, Agent, or Firm*—Birch, Stewart, Kolasch & Birch, LLP

(57) ABSTRACT

The liquid droplet ejection head comprises: first nozzles which eject droplets of a first liquid to an ejection receiving medium; second nozzles which eject droplets of a second liquid to the ejection receiving medium; first pressure chambers which are connected to the first nozzles and filled with the first liquid to be ejected from the first nozzles; first pressure generating devices which cause the first liquid to be ejected from the first nozzles by applying pressure to the first liquid inside the first pressure chambers; second pressure chambers which are connected to the second nozzles and filled with the second liquid to be ejected from the second nozzles; and second pressure generating devices which cause the second liquid to be ejected from the second nozzles by applying pressure to the second liquid inside the second pressure chambers, wherein the first nozzles and the second nozzles are arranged in a two-dimensional array and disposed adjacently in mutual proximity so as to be aligned in a sub-scanning direction which is parallel to a relative direction of movement of the ejection receiving medium and the liquid droplet ejection head, in such a manner that the first liquid and the second liquid ejected respectively from the first nozzle and the second nozzle that are arranged in mutual proximity are deposited at substantially same position on the ejection receiving medium.

14 Claims, 18 Drawing Sheets

FOREIGN PATENT DOCUMENTS

| | | | |
|---|---|---|---|
| JP | 10-157111 | A | 6/1998 |
| JP | 2001-146010 | A | 5/2001 |
| JP | 2001-334661 | A | 12/2001 |
| JP | 2002-36519 | A | 2/2002 |
| JP | 2002-240328 | A | 8/2002 |

* cited by examiner

⊙ RECORDING MEDIUM CONVEYANCE DIRECTION
(FROM BACK TO FRONT WITH RESPECT TO DRAWING SHEET)

LIQUID DROPLET EJECTION HEAD AND IMAGE FORMING APPARATUS

BACKGROUND OF THE INVENTION

1. Field of the Invention

The present invention relates to a liquid droplet ejection head and an image forming apparatus, and more particularly, to a structure of a liquid droplet ejection head in which a plurality of liquid droplet ejection ports (nozzles) are arranged two-dimensionally at high density, and an image forming apparatus which forms an image on a recording medium by means of liquid droplets ejected from the liquid droplet ejection head.

2. Description of the Related Art

Japanese Patent Application Publication No. 4-329151 describes a recording apparatus having a recording head which combines a spray mechanism for white ink only, which uses a piezoelectric element, and a spray mechanism for a dye sublimation coloring material, which uses a heat generating resistance element. This recording apparatus forms colored ink by causing white ink and coloring material sprayed from the recording head to collide with each other during flight, in such a manner that recording is performed by means of the colored ink landing on a recording medium.

Although Japanese Patent Application Publication No. 4-329151 discloses a structure of a recording head comprising a spray mechanism using a piezoelectric element and a spraying mechanism using a heat generating resistance element, it does not describe a high-density arrangement of ejection ports or pressure chambers.

In general, the ejection method using piezoelectric elements (a "piezo" method) has the merit of allowing a great deal of freedom in the selection of the material of the ejection liquid; however, the piezoelectric elements and pressure chambers are large in size, and in the case of a head composition which ejects two liquids, it is difficult to achieve a high-density arrangement of the pressure chambers.

As opposed to this, a method (thermal method) which heats a liquid by means of a heat-generating element and ejects the liquid by means of the gas bubbles formed by film boiling makes it relatively easier to achieve high density, compared to the piezo method described above; however, since it is necessary to boil the ejection liquid, the amount of freedom in selecting the ejection liquid is reduced.

Japanese Patent Application Publication No. 10-24564 discloses a method and structure of an ejection head for achieving same, whereby two types of liquids, which are reactive, are combined within the head and are ejected from ejection ports, recording being performed by means of the ejected liquid landing on a recording medium.

However, since the two types of reactive liquid are combined inside a flow channel connected to an ejection port (nozzle), there is a possibility that blockages may occur due to the combined reaction of the two liquids. Hence, from the viewpoint of avoiding blockages of this kind, a method is desired in which the two liquids are combined after ejection.

SUMMARY OF THE INVENTION

The present invention has been contrived with the foregoing circumstances in view, an object thereof being to provide a structure of a liquid droplet ejection head, and an image forming apparatus using this liquid droplet ejection head, whereby a method which combines two liquids after ejection can be adopted, while also using a piezo method which allows high freedom of selection of the ejection liquid, and allowing a high density arrangement of the pressure chambers.

In order to attain the aforementioned object, the present invention is directed to a liquid droplet ejection head, comprising: first nozzles which eject droplets of a first liquid to an ejection receiving medium; second nozzles which eject droplets of a second liquid to the ejection receiving medium; first pressure chambers which are connected to the first nozzles and filled with the first liquid to be ejected from the first nozzles; first pressure generating devices which cause the first liquid to be ejected from the first nozzles by applying pressure to the first liquid inside the first pressure chambers; second pressure chambers which are connected to the second nozzles and filled with the second liquid to be ejected from the second nozzles; and second pressure generating devices which cause the second liquid to be ejected from the second nozzles by applying pressure to the second liquid inside the second pressure chambers, wherein the first nozzles and the second nozzles are arranged in a two-dimensional array and disposed adjacently in mutual proximity so as to be aligned in a sub-scanning direction which is parallel to a relative direction of movement of the ejection receiving medium and the liquid droplet ejection head, in such a manner that the first liquid and the second liquid ejected respectively from the first nozzle and the second nozzle that are arranged in mutual proximity are deposited at substantially same position on the ejection receiving medium.

According to the present invention, the first liquid filled into the first pressure chambers is ejected from the first nozzles by means of the pressure generated by the first pressure generating devices. Similarly, the second liquid filled into the second pressure chambers is ejected from the second nozzles by means of the pressure generated by the second pressure generating devices. The first liquid and the second liquid ejected respectively from a first nozzle and a second nozzle which are positioned adjacently in mutual proximity on the same line in the sub-scanning direction, which is parallel to the relative movement direction of the ejection receiving medium with respect to the liquid droplet ejection head, are deposited in substantially the same position on the ejection receiving medium, and the two liquids mix together.

More specifically, according to the present invention, a high-density nozzle arrangement is possible, and it is possible for the two liquids to mix together on the ejection receiving medium after the two liquids have been ejected. Furthermore, in the present invention, it is possible to use an actuator such as a piezoelectric element in the first pressure generating device and the second pressure generating device, and hence the freedom of selection of the ejection liquid is increased.

Preferably, the first pressure chambers and the second pressure chambers are formed to have an approximately square planar shape; each of the first pressure chambers has a nozzle connection port for directing the first liquid to the first nozzle, and a supply port for introducing the first liquid into the first pressure chamber, the nozzle connection port and the supply port being disposed on a diagonal of the approximately square planar shape; and each of the second pressure chambers has a nozzle connection port for directing the second liquid to the second nozzle, and a supply port for introducing the second liquid into the second pressure chamber, the nozzle connection port and the supply port being disposed on a diagonal of the approximately square planar shape.

By adopting a substantially square planar shape for the first pressure chambers and second pressure chambers, the deformation efficiency of the first pressure generating device and the second pressure generating device which cause displacement of the approximately square-shaped pressure chamber surface is improved. Furthermore, by arranging the nozzle connection port and the supply port on a diagonal of a substantially square-shaped pressure chamber, the liquid becomes less liable to stagnate within the pressure chamber and air bubble expulsion properties are improved.

Preferably, a first nozzle inclination angle which defines a direction of ejection of the first liquid from the first nozzles, and a second nozzle inclination angle which defines a direction of ejection of the second liquid from the second nozzles are set in such a manner that the droplet of the first liquid ejected from the first nozzle and the droplet of the second liquid ejected from the second nozzle are propelled toward substantially the same position on the ejection receiving medium.

By means of this composition, two types of liquid droplets can be made to land substantially simultaneously at substantially the same position on the ejection receiving medium. Here, "substantially the same position" means a positional relationship whereby the first liquid droplet and the second liquid droplet landing on the ejection receiving medium are able to make contact, coalesce and combine with each other.

Preferably, the first pressure chambers and the second pressure chambers are arranged in a layered structure, in such a manner that the first pressure chambers and the second pressure chambers in different layers partially overlap with each other and non-overlapping regions thereof are aligned in the sub-scanning direction.

An even higher density nozzle pitch can be achieved by arranging the pressure chambers in a layered structure of this kind.

Preferably, the liquid droplet ejection head further comprises: a nozzle plate in which the first nozzles and the second nozzles are formed, wherein the first liquid having a relatively high viscosity is filled into the first pressure chambers formed in a layer which is nearer to the nozzle plate, and the second liquid having a relatively low viscosity is filled into the second pressure chambers formed in a layer which is further from the nozzle plate.

Focusing on the nozzle side flow channels leading from the pressure chambers to the nozzles, the flow channel resistance of the nozzle side flow channels from the first pressure chambers which are nearer to the nozzle plate is less than the flow channel resistance of the nozzle side flow channels leading from the second pressure chambers which are further from the nozzle plate. Therefore, high-viscosity liquid can be ejected readily by filling a first liquid of high viscosity into the first pressure chambers in the layer nearer the nozzle plate. The connecting sections between the nozzle side flow channels and the pressure chambers correspond to "nozzle connection ports".

Preferably, a cross-sectional area and length of first nozzle side flow channels leading from the first pressure chambers to the first nozzles, and a cross-sectional area and length of second nozzle side flow channels leading from the second pressure chambers to the second nozzles are set in such a manner that a ratio between an ejected volume of the first liquid ejected from the first nozzles and an ejected volume of the second liquid ejected from the second nozzles is a prescribed value.

For example, the shapes of the respective nozzle side flow channels are designed in such a manner that the ratio of the ejection amounts is a prescribed value, if the same drive signal is applied to the first pressure generating device and the second pressure generating device. Thereby, it is possible to achieve a composition in which a common drive waveform is used for the first nozzles and the second nozzles.

Preferably, the first nozzles and the second nozzles are arranged two-dimensionally so as to be aligned in a row direction which is substantially parallel to a main scanning direction that is perpendicular to the relative direction of movement of the ejection receiving medium and the liquid droplet ejection head, and in a column direction which extends substantially in the sub-scanning direction, being oblique to the row direction at a prescribed angle; and a first common flow channel which supplies the first liquid to the first pressure chambers corresponding to the first nozzles aligned in the column direction, and a second common flow channel which supplies the second liquid to the second pressure chambers corresponding to the second nozzles aligned in the column direction, are formed in line with nozzle rows aligned in the column direction.

The nozzle rows extending in substantially the sub-scanning direction form a dot column (dot lines) in a line extending in the main scanning direction on the main scanning direction, by being driven (performing ejection) successively from one end of the nozzle row to the other end thereof, in conjunction with the relative movement of the ejection receiving medium. When driving the nozzles to forming a dot line in this way (namely, when performing main scanning), by arranging the first common flow channel and the second common flow channel in line with the nozzle rows extending substantially in the sub-scanning direction, it is possible to prevent concentration of load on one particular common flow channel during the ejection operation, and it is also possible to improve refilling characteristics.

Preferably, a first common flow channel which supplies the first liquid to the first pressure chambers and a second common flow channel which supplies the second liquid to the second pressure chambers are arranged in a layered structure, in such a manner that the first common flow channel and the second common flow channel in different layers partially overlap with each other.

By adopting a composition in which the first common flow channel and the second common flow channels are arranged in a layered fashion, it is possible to achieve even higher density.

Preferably, the first liquid contains a coloring material, and the second liquid contains at least one of a fixing reaction promoting agent and a permeation retarding agent.

If a fixing reaction promoting agent is used as the second liquid, then the fixing reaction proceeds rapidly after deposition of the liquids, and hence colors bleeding or landing interference can be prevented. Furthermore, if a permeation retarding agent is used as the second liquid, then permeation of the first liquid into the ejection receiving medium after landing thereon is impeded by the action of the permeation retarding agent. In other words, colors bleeding is prevented since the permeation rate is reduced during fixing.

Preferably, of the first nozzle and the second nozzle which are disposed in a mutually proximate arrangement, the first nozzle is disposed on a downstream side and the second nozzle is disposed on an upstream side in the relative movement direction of the ejection receiving medium with respect to the liquid droplet ejection head.

By adopting this arrangement, the second liquid (fixing reaction promoting agent or permeation retarding agent) ejected from the second nozzle is deposited firstly onto the ejection receiving medium, whereupon, at a slight time difference thereafter, the first liquid is deposited onto the ejection receiving medium. Therefore, the first liquid containing a coloring material does not land directly on the ejection receiving medium, and therefore, bleeding can be prevented reliably.

Preferably, the second nozzles are arranged in fewer number than the first nozzles, at a prescribed ratio with respect to the first nozzles.

For example, there is a composition in which second nozzles are arranged at every alternate row in the matrix array. By reducing the number of second nozzles, second pressure chambers, and the like, by a uniform ratio, it is possible to simplify manufacture and to reduce costs.

Preferably, a diameter of a dot formed by the droplet of the second liquid ejected from the second nozzle and deposited on the ejection receiving medium is set to a value whereby the dot has a surface area covering a region of a plurality of dots formed by the droplets of the first liquid which are ejected from the first nozzles that are mutually adjacent in a main scanning direction perpendicular to the relative movement direction of the ejection receiving medium and the liquid droplet ejection head, and deposited adjacently on the ejection receiving medium in an alignment in the main scanning direction.

In the case of a composition where the number of second nozzles is lower than the number of first nozzles, desirably, the second nozzles form dots of a size which is greater than the region of the dots formed by a plurality of first nozzles, in such a manner that the region of the dots formed by a plurality of first nozzles is covered by one second nozzle.

Preferably, a second nozzle inclination angle which defines a direction of ejection of the second liquid from the second nozzles is set in such a manner that the droplet of the second liquid ejected from the second nozzle is deposited in an approximately central position between two dots which are formed by two droplets of the first liquid ejected from the first nozzles that are mutually adjacent in the main scanning direction, and deposited adjacently on the ejection receiving medium in an alignment in the main scanning direction.

Thereby, it is possible to form the dots created by the second liquid to the minimum necessary size, and hence the amount of second liquid consumed can be reduced.

Preferably, within each of the plurality of dot regions, ejection of the droplet from the second nozzle is controlled in such a manner that the dot is formed by the second liquid only in cases where at least one dot is formed by the first nozzle.

The second liquid has a prescribed role when combined with the first liquid (for instance, promoting a fixing reaction, slowing the permeation rate, or the like), and hence there is no need to deposit the second liquid only in cases where no droplets of the first liquid are to be ejected. Therefore, by avoiding wasteful ejection of the second liquid and ejecting the second liquid only when it is necessary in relation to ejection of droplets of the first liquid, it is possible to reduce the amount of the second liquid consumed.

Preferably, the liquid droplet ejection head further comprises a mixture preventing device which prevents mixing of the first liquid and the second liquid, the mixture preventing device being arranged on an ejection surface on which the first nozzles and the second nozzles are formed, between the first nozzles and the second nozzles.

For the mixture prevention device, it is possible to adopt, for example, a groove, a dividing member, surface processing, or a combination of these. By adopting a mixture preventing device of this kind, it is possible to prevent liquid (first liquid or second liquid) that has adhered to the ejection surface of the liquid droplet ejection head from being transmitted over the ejection surface in such a manner that it enters into the orifice of a nozzle which ejects the other type of liquid.

In order to attain the aforementioned object, the present invention is also directed to an image forming apparatus, comprising: the above-described liquid droplet ejection head; a first liquid supply device which supplies the first liquid to the liquid droplet ejection head; a second liquid supply device which supplies the second liquid to the liquid droplet ejection head; a conveyance device which performs a relative movement of the liquid droplet ejection head and the ejection receiving medium, by conveying at least one of the liquid droplet ejection head and the ejection receiving medium in a specified direction; and a droplet ejection control device which achieves a desired dot arrangement on the ejection receiving medium by causing the first and second liquids to be ejected from the liquid droplet ejection head toward the ejection receiving medium, in conjunction with the relative movement caused by the conveyance device, wherein an image is formed on the ejection receiving medium by means of droplets of the first and second liquids ejected from the first and second nozzles.

A compositional example of a liquid droplet ejection head in the image forming apparatus according to the present invention is a full line type inkjet head having a nozzle row in which a plurality of nozzles are arranged through a length corresponding to the full width of the ejection receiving medium.

In this case, a mode may be adopted in which a plurality of relatively short ejection head blocks having nozzles rows which do not reach a length corresponding to the full width of the ejection receiving medium are combined and joined together, thereby forming nozzle rows of a length that correspond to the full width of the ejection receiving medium.

A full line type inkjet head is usually disposed in a direction perpendicular to the relative feed direction (relative conveyance direction) of the ejection receiving medium, but modes may also be adopted in which the inkjet head is disposed following an oblique direction that forms a prescribed angle with respect to the direction perpendicular to the relative conveyance direction.

The "ejection receiving medium" in the image forming apparatus indicates a medium on which an image is recorded by means of liquid ejected from the liquid droplet ejection head (this medium may also be called a recording medium, ejection receiving medium, print medium, image forming medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed by means of a liquid droplet ejection head, and an intermediate transfer medium, and the like.

The movement device for causing the ejection receiving medium and the liquid droplet ejection head to move relative to each other may include a mode where the ejection receiving medium is conveyed with respect to a stationary (fixed) head, or a mode where a head is moved with respect to a stationary ejection receiving medium, or a mode where both the head and the ejection receiving medium are moved.

According to the present invention, it is possible to achieve a high density arrangement of nozzles in a liquid droplet ejection head using a system which combines two liquids after ejection. Furthermore, in the present invention, it is possible to use an actuator such as a piezoelectric element in the first pressure generating devices and the second pressure generating devices and hence the freedom of selection of the ejection liquid is increased.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment; General Composition of Inkjet Recording Apparatus

Figure 1:
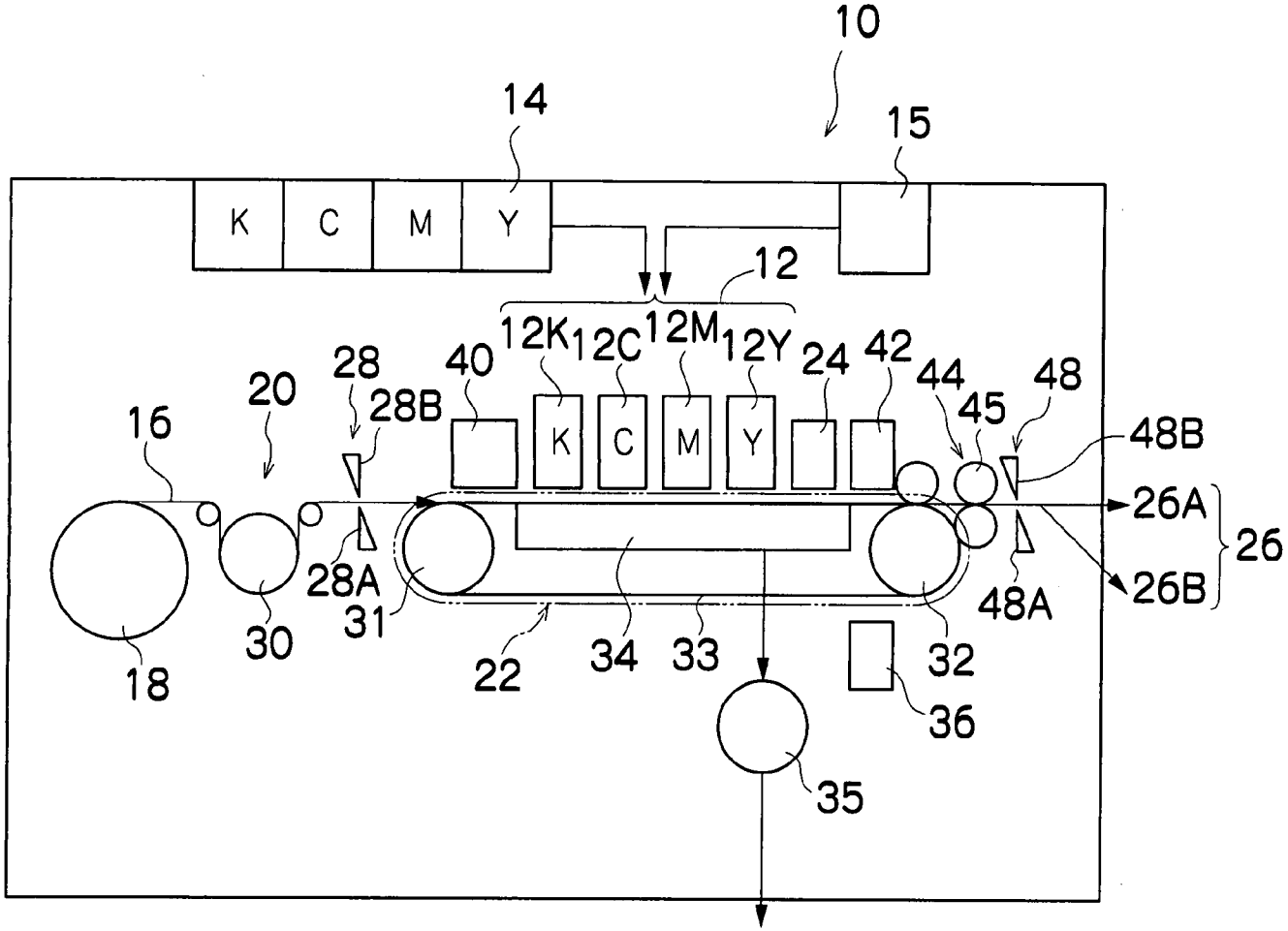
FIG. 1 is a general compositional diagram of an inkjet recording apparatus according to a first embodiment of the present invention.

FIG. 1 is a diagram of the general composition of an inkjet recording apparatus according to a first embodiment of the present invention. As shown in FIG. 1, the inkjet recording apparatus 10 comprises: a print unit 12 having a plurality of inkjet heads (hereafter, called "heads") 12K, 12C, 12M and 12Y provided for ink colors of black (K), cyan (C), magenta (M), and yellow (Y), respectively; an ink storing and loading unit 14 for storing colored inks (corresponding to the first liquid, hereafter called "liquid A" for the sake of convenience) to be supplied to the print heads 12K, 12C, 12M, and 12Y, a treatment liquid storing and loading unit 15 for storing treatment liquid (corresponding to the second liquid, hereafter called "liquid B" for the sake of convenience) to be supplied to the print heads 12K, 12C, 12M, and 12Y; a paper supply unit 18 for supplying recording paper 16; a decurling unit 20 removing curl in the recording paper 16; a suction belt conveyance unit 22 disposed facing the nozzle face (ink ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

The ink storing and loading unit 14 has ink tanks for storing the inks (liquid A) of K, C, M and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

The treatment liquid storing and loading unit 15 has a treatment liquid tank for storing treatment liquid (liquid B) to be supplied commonly to the heads 12K, 12C, 12M, and 12Y, and this tank is connected to the heads 12K, 12C, 12M, and 12Y by means of prescribed channels. Furthermore, the treatment liquid storing and loading unit 15 has a reporting device (display device, alarm sound generating device) for issuing a report when the remaining amount of treatment liquid has become low.

In the present embodiment, one type of treatment liquid is supplied to the respective heads 12K, 12C, 12M and 12Y, but it is also possible to adopt a composition in which a plurality of different types of treatment liquids are used, with respect to the inks of different colors. In this case, the treatment liquid storing and loading unit 15 is provided with a mechanism for preventing the loading of the wrong type of treatment liquid.

More details are described below, but the heads 12K, 12C, 12M and 12Y comprise nozzles for ejecting liquid A (which correspond to the first nozzles and which may be referred to as "liquid A ejection nozzles" below, for the sake of convenience), and nozzles for ejecting liquid B (which correspond to the second nozzles and which may be referred to as "liquid B ejection nozzles" below, for the sake of convenience), these nozzles being arranged in a two-dimensional array, in such a manner that liquid A and liquid B can be deposited onto substantially the same position on the recording paper 16.

The ink (liquid A) used in the present embodiment is, for instance, colored ink including anionic polymer, namely, a polymer containing negatively charged surface-active ions. Furthermore, the treatment liquid (liquid B) used in the present embodiment is, for instance, transparent reaction promoting agent including cationic polymer, namely, a polymer containing positively charged surface-active ions.

When the liquid A and the liquid B are mixed, the insolubilizing reaction and/or fixing reaction of the ink coloring material proceeds due to a chemical reaction. Here the term "insolubilizing" includes a phenomenon whereby the coloring material separates or precipitates from the solvent, or a phenomenon whereby the liquid in which the coloring material is dissolved changes (coagulates) to a solid phase. Furthermore, the term "fixing" may indicate a mode where the coloring material is held on the surface of the recording medium, a mode where the coloring material permeates into the recording medium and is held therein, or a mode combining these states.

The reaction speed can be adjusted by regulating the composition of the liquid A and the liquid B, the concentration of the materials contributing to the reaction, or the like, and desired ink insolubilizing and/or ink fixing properties (fixing speed) can be achieved.

As for the supply system of the recording medium, in FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (shown in FIG. 9) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area, as shown in the present embodiment, is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
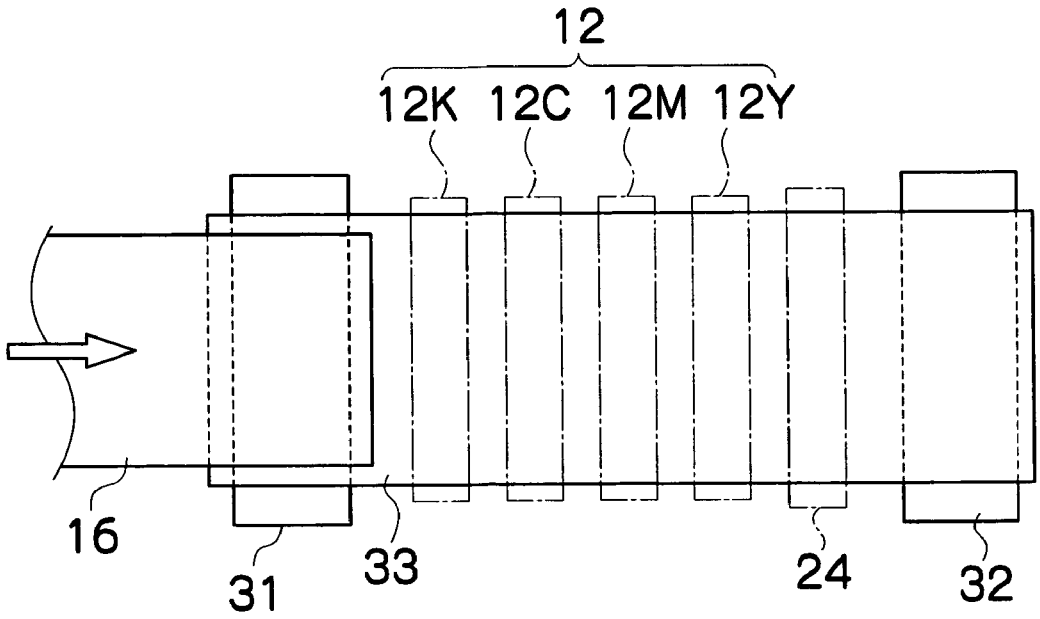
FIG. 2 is a plan view of the principal part of the peripheral area of a print unit in the inkjet recording apparatus shown in FIG. 1.

The print heads 12K, 12M, 12C and 12Y of the print unit 12 are full line heads having a length corresponding to the maximum width of the recording paper 16 used with the inkjet recording apparatus 10 (see FIG. 2), and comprising a plurality of nozzles for ejecting ink and nozzles for ejecting treatment liquid arranged on a nozzle face through a length exceeding at least one edge of the maximum-size recording paper (namely, the full width of the printable range).

The print heads 12K, 12C, 12M and 12Y are arranged in color order (black (K), cyan (C), magenta (M), yellow (Y)) from the upstream side in the feed direction of the recording paper 16, and these respective heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M and 12Y, respectively, onto the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 24 shown in FIG. 1 has an image sensor for capturing an image of the ink-droplet deposition result of the printing unit 12, and functions as a device to check for ejection defects such as clogs of the nozzles in the printing unit 12 from the ink-droplet deposition results evaluated through the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

A test pattern or the target image printed by the print heads 12K, 12C, 12M, and 12Y of the respective colors is read in by the print determination unit 24, and the ejection performed by each head is determined. The ejection determination includes detection of the ejection, measurement of the dot size, and measurement of the dot formation position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively.

When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of the Head

Next, the structure of a head will be described. The heads 12K, 12C, 12M and 12Y of the respective ink colors have the same structure, and a reference numeral 50 is hereinafter designated to any of the heads.

Figure 3:
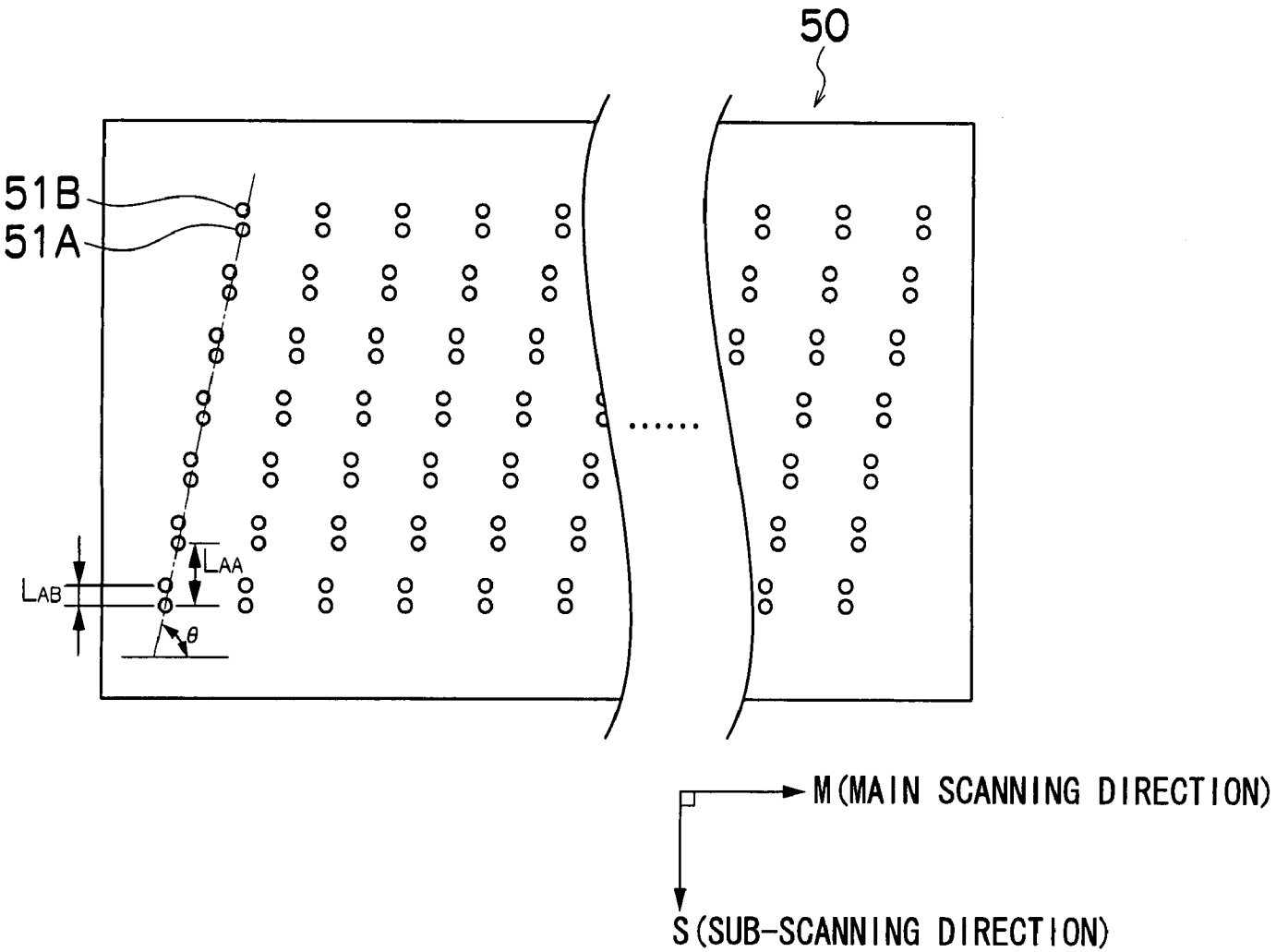
FIG. 3 is a plan diagram showing a schematic view of an example of a nozzle arrangement in the print head.

FIG. 3 is a plan diagram showing a schematic view of an example of a nozzle arrangement in the print head 50. In FIG. 3, reference numeral 51A indicates a nozzle forming an ejection port for ejecting ink (liquid A) (corresponding to a first nozzle and referred to as a "liquid A ejection nozzle" below, as and when necessary), and reference numeral 51B indicates a nozzle forming an ejection port for ejecting treatment liquid (liquid B) (corresponding to a second nozzle and referred to as a "liquid B ejection nozzle" below, as and when necessary).

As shown in FIG. 3, the liquid A ejection nozzles 51A and the liquid B ejection nozzles 51B are arranged respectively in a two-dimensional matrix array at standard arrangement intervals in a row direction which follows a direction (indicated by arrow M; main scanning direction) that is perpendicular to the conveyance direction of the recording medium (indicated by arrow S; sub-scanning direction), and an oblique column direction having a uniform non-perpendicular angle θ with respect to this row direction.

Furthermore, in the case of the present embodiment, the liquid B ejection nozzles 51B are arranged adjacently to the respective liquid A ejection nozzles 51A in such a manner that they are arranged on the same line in the sub-scanning direction. Taking the nozzle-to-nozzle distance between the liquid A ejection nozzle 51A and the liquid B ejection nozzle 51B adjacent to each other in the sub-scanning direction, to be $L_{AB}$, and taking the distance in the sub-scanning direction between the mutually adjacent liquid A ejection nozzles 51A arranged in separate rows that are mutually adjacent in the sub-scanning direction (the distance between the rows of the liquid A ejection nozzles 51A) to be $L_{AA}$, the relationship $L_{AB}<L_{AA}$ is established, and the effective nozzle interval when projected to an alignment in the lengthwise direction of the head (main scanning direction) is $P=L_{AA}/\tan\theta$. More specifically, the arrangement can be treated equivalently to a nozzle arrangement in which the respective nozzles 51A are arranged in a linear fashion at uniform pitch P, in the main scanning direction.

FIG. 3 shows a schematic illustration, and by adopting a matrix type nozzle arrangement of this kind, it is possible to achieve a high-density nozzle composition in which the liquid A ejection nozzles reach a density of 1800 to 2400 nozzles per inch when projected to an alignment in the main scanning direction. The two-dimensional arrangement of the liquid B ejection nozzles 51B is offset by a distance of $L_{AB}$ in the sub-scanning direction with respect to the two-dimensional arrangement of the liquid A ejection nozzles 51A, and therefore a similar pitch to that of the liquid A ejection nozzles 51A is also achieved for the liquid B ejection nozzles 51B (in the case of the present embodiment, the arrangement density of the liquid B ejection nozzles is the same as the arrangement density of the liquid A ejection nozzles).

Figure 4:
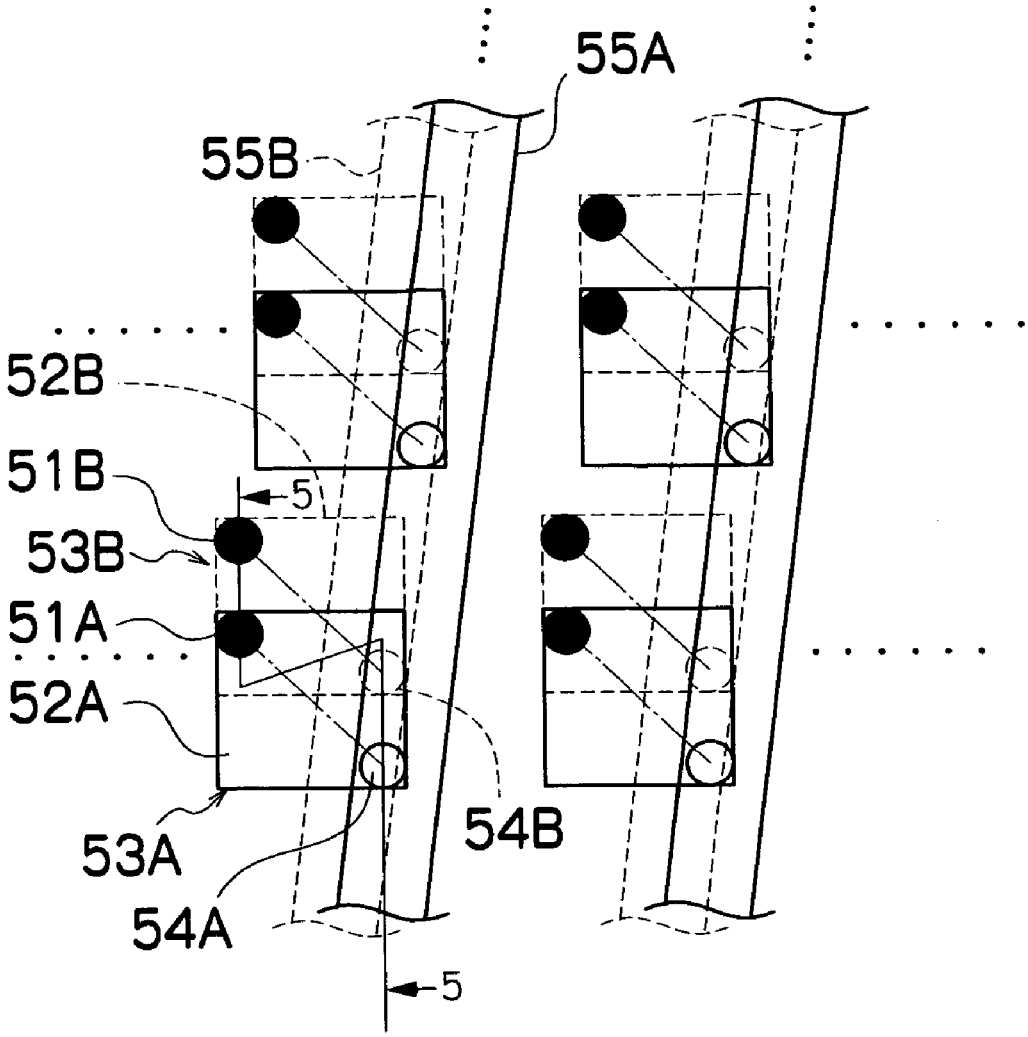
FIG. 4 is a plan view perspective diagram of the principal part of the internal structure of the print head.
Figure 5:
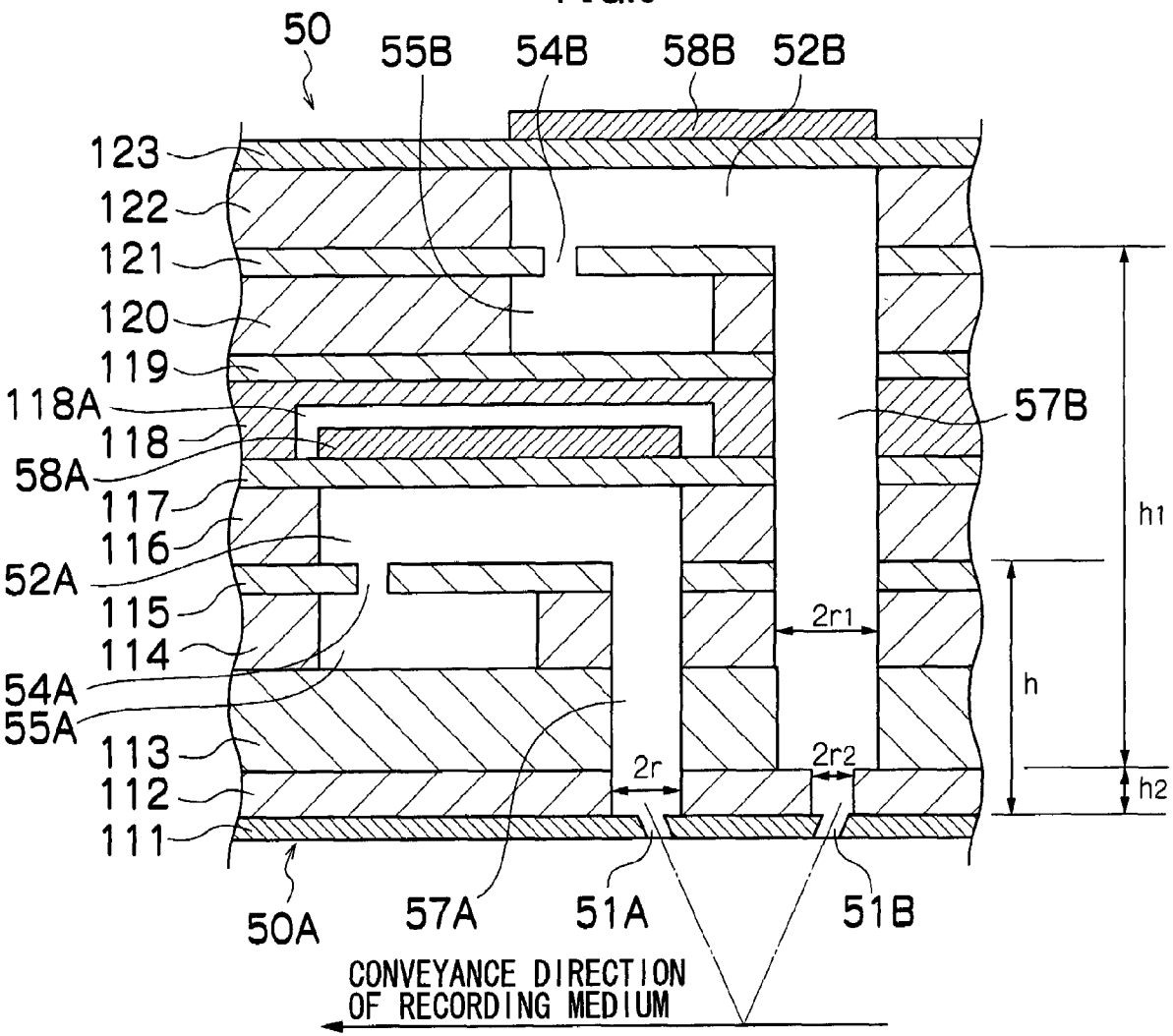
FIG. 5 is a cross-sectional diagram of the principal part of the internal structure of the print head.

FIG. 4 is a plan view perspective diagram of the principal part of the internal composition of the print head 50, and FIG. 5 is a cross-sectional diagram, along line 5-5 in FIG. 4, showing the flow channel structure of an ejection element corresponding to a pair comprising a liquid A ejection nozzle 51A and a liquid B ejection nozzle 51B. As shown in FIGS. 4 and 5, a pressure chamber 52A connected to a liquid A ejection nozzle 51A (corresponding to a first pressure chamber, which may be referred to as "liquid A pressure chamber" below, as and when necessary) and a pressure chamber 52B connected to a liquid B ejection nozzle 51B (corresponding to a second pressure chamber, which may be referred to as "liquid B pressure chamber" below, as and when necessary)

are arranged in a layered structure in the thickness direction of the head, which is perpendicular to the nozzle surface 50A.

Here, an ejection element unit constituted by one liquid A ejection nozzle 51A and a corresponding liquid A pressure chamber 52A, and the like, is called an ink chamber unit 53A, and an ejection element unit constituted by one liquid B ejection nozzle 51B and a corresponding liquid B pressure chamber 52B, and the like, is called a treatment liquid chamber unit 53B.

Each of the pressure chambers 52A and 52B has an approximately square planar shape (the shape of the chamber when viewed in a direction perpendicular to the nozzle surface 50A, in other words, the planar shape of the pressure chamber when projected to a plane parallel to the nozzle surface 50A) (see FIG. 4). The liquid B pressure chamber 52B is disposed in a position that is offset from the liquid A pressure chamber 52A in the sub-scanning direction, and hence the pressure chambers 52A and 52B are arranged in a layered fashion in the print head 50 in such a manner that they are partially overlapping. More specifically, as shown in FIG. 4, the pressure chambers 52A and 52B having this overlapping relationship are arranged in such a manner that the non-overlapping portions of the pressure chambers 52A and 52B are aligned in the sub-scanning direction. Thereby, a high density of the effective nozzle pitch is achieved. In other words, since the nozzle 51A and the nozzle 51B are arranged so as to be on the same line in the same sub-scanning direction, the pressure chamber 52A and the pressure chamber 52B are overlapping in a layered structure, and by arranging the non-overlapping sections of the pressure chambers so as to be aligned in the sub-scanning direction, the nozzles can be arranged at high density.

Furthermore, each of the pressure chambers 52A and 52B has an outlet port (nozzle flow channel connection port) connecting to a nozzle (51A or 51B), and a supply port 54A or 54B connected to the supply side, provided at respective ends of one diagonal line of the approximately square planar shape of the chamber.

The liquid A pressure chamber 52A is connected through the supply port 54A to a supply side common flow channel 55A (which corresponds to a first common flow channel and may be called "liquid A common flow channel" below, as and when necessary), and the liquid B pressure chamber 52B is connected through the supply port 54B to a supply side common flow channel 55B (which corresponds to a second common flow channel and may be called "liquid B common flow channel" below, as and when necessary).

The internal structure of the print head 50 is described now with reference to FIG. 5. As shown in FIG. 5, the print head 50 according to the present embodiment is manufactured by layering and bonding together a plurality of plate members (111 to 123), and has an internal structure in which the liquid A pressure chambers 52A and the liquid B pressure chambers 52B are formed in a layered fashion in the direction of lamination (the vertical direction in FIG. 5).

The liquid A ejection nozzle 51A connecting to the liquid A pressure chamber 52 and the liquid B pressure chamber nozzle 51B connecting to the liquid B pressure chamber 52B are formed in the nozzle plate 111, which forms the bottom-most surface of the head. Here, a "nozzle" is the final aperture portion from which liquid is ejected. Desirably, the nozzle size is designed to a diameter of approximately several tens μm, and to a length of several tens μm.

The nozzles 51A and 51B are formed to have shapes whereby the axes of the ejection ports are inclined respectively to a prescribed nozzle inclination angle, in order to restrict the direction of flight of the liquid droplets in such a manner that the two types of liquid ejected in a substantially simultaneous fashion from the nozzles land on substantially the same position on the recording medium.

Furthermore, the liquid A common flow channel 55A for supplying ink (liquid A) to the lower-positioned liquid A pressure chamber 52A and the liquid B common flow channel 55B for supplying a treatment liquid (liquid B) to the upper-positioned liquid B pressure chamber 52B are provided in the head 50, and the respective common flow channels 55A and 55B are arranged in respectively different layers corresponding to the pressure chambers 52A and 52B, as illustrated in FIG. 5.

The liquid A pressure chamber 52A is connected to the liquid A common flow channel 55A via the supply port 54A, and it is also connected to the liquid A ejection nozzle 51A forming an ink ejection port via the first nozzle flow channel 57A. Similarly, the liquid B pressure chamber 52B is connected to the liquid B common flow channel 55B via the supply port 54B, and it is also connected to the liquid B ejection nozzle 51B forming the treatment liquid ejection port via the second nozzle flow channel 57B.

The liquid A common flow channel 55A is connected to an ink tank (not shown in FIG. 5, but indicated by reference numeral 60A in FIG. 8), which is a base tank that supplies ink, and the ink supplied from the ink tank 60 is delivered through the liquid A common flow channel 55A in FIG. 5 to the respective liquid A pressure chambers 52A. Similarly, the liquid B common flow channel 55B is connected to a treatment liquid tank forming a supply source for a treatment liquid (liquid B) (this tank is not illustrated in FIG. 5 and is denoted with reference numeral 60B in FIG. 8), and the treatment liquid supplied from the treatment liquid tank 60B is distributed to the respective liquid B pressure chambers 52B via the liquid B common flow channel 55B in FIG. 5.

In FIG. 5, reference numeral 58A denotes a first actuator which applies an ejection energy to the ink by pressurizing the liquid A pressure chamber 52A, and reference numeral 58B denotes a second actuator which applies an ejection energy to the treatment liquid by pressurizing the liquid B pressure chamber 52B. A piezoelectric body, such as a piezo element, is suitable as the actuators 58A and 58B.

As stated previously, the liquid A ejection nozzles 51A and the liquid B ejection nozzles 51B are formed in the same nozzle plate 111, and the distance from the liquid A pressure chamber 52A to the liquid A ejection nozzle 51A (the length of the first nozzle flow channel 57A) is different to the distance from the liquid B pressure chamber 52B to the liquid B ejection nozzle 51B (the length of the second nozzle flow channel 57B).

In the case of the present embodiment, a liquid A having a relatively higher viscosity of the two types of liquid (i.e., A>B in viscosity) is supplied to the pressure chamber that is nearer to the nozzle plate 111 (liquid A pressure chamber 52A), and the liquid A is ejected from the liquid A ejection nozzle 51A, whereas the liquid B having a relatively lower viscosity is supplied to the pressure chamber that is further from the nozzle plate 111 (liquid B pressure chamber 52B), and the liquid B is ejected from the liquid B ejection nozzle 51B.

Furthermore, the respective shapes (cross-sectional area and length) of the first nozzle flow channel 57A and the second nozzle flow channel 57B are designed in such a manner that, when the first actuator 58A and the second actuator 58B are driven under prescribed common conditions, the ratio in the ejection volumes of the liquid A and the liquid B is a prescribed value.

In FIG. 5, the first nozzle flow channel 57A is a uniform circular tube of radius r and length h. On the other hand, the second nozzle flow channel 57B has a structure composed of two circular tubes of different radii. More specifically, the second nozzle supply channel 57B is composed of, from the side nearest to the liquid B pressure chamber 52B, a circular tube of radius $r_1$ and length $h_1$ (hereinafter, called the "thick tube"), and a circular tube of radius $r_2$ ($<r_1$) and length $h_2$ (hereinafter, called the "thin tube"), these tubes being connected in such a manner that the central axes thereof are mutually coinciding. If a flow channel is formed by combining circular tubes of different radii in this manner, then by situating the tubes in such a manner that the radius becomes smaller, sequentially, from the side adjacent to the pressure chamber, the number of stagnant points within the nozzle flow channel is reduced, and hence bubble elimination properties and refilling properties are improved.

A print head 50 having this structure can be fabricated by bonding the plurality of plate members (111 to 123) including a flow channel plate comprising a thin plate made of stainless steel, or the like, formed with holes and/or grooves, by means of etching, or the like. In this case, circular tubes of different radii are constituted by different flow channel plates.

In this way, since the holes in any one flow channel plate are of substantially uniform radius, processing is more straightforward compared to a case where holes of different radii are formed (processed by etching, or the like) in the same plate.

In the example in FIG. 5, layers are formed from the bottom in the following sequence: the nozzle plate 111, a first nozzle flow channel plate 112, a second nozzle flow channel plate 113, a first common flow channel plate 114, a first supply port plate 115, a first pressure chamber plate 116, a first diaphragm plate 117, an actuator avoiding plate 118, a third nozzle supply channel plate 119, a second common flow channel plate 120, a second supply port plate 121, a second pressure chamber plate 122, and a second diaphragm plate 123.

The first nozzle flow channel plate 112 is a member which constitutes a portion of the first nozzle flow channel 57A and the thin tube of the second nozzle flow channel 57B. The second nozzle flow channel plate 113 is a member which constitutes a portion of the first nozzle flow channel 57A and the thick tube of the second nozzle flow channel 57B. The first common flow channel plate 114 is a member which constitutes the side walls of the liquid A common flow channel 55A, a portion of the first nozzle flow channel 57A, and a portion of the thick tube of the second nozzle flow channel 57B.

The first supply port plate 115 is a member which constitutes the supply port 54A (corresponding to the first supply ports), a portion of the first nozzle flow channel 57A, and a portion of the thick tube of the second nozzle flow channel 57B. The first pressure chamber plate 116 is a member which constitutes the side walls of the liquid A pressure chamber 52A and a portion of the thick tube of the second nozzle flow channel 57B. The first vibration plate 117 is a member which seals the upper face of the liquid A pressure chamber 52A (forming the ceiling thereof), and furthermore, also constitutes a portion of the thick tube of the second nozzle supply channel 57B. Furthermore, a first actuator 58A is fixed to the first diaphragm plate 117, in a position corresponding to each liquid A pressure chamber 52A.

The actuator avoiding plate 118 has a recess section 118A for ensuring a space in which the first actuator 58A is disposed, and it allows lamination of further layers above the first actuator 58A. Moreover, the actuator avoiding plate 118 constitutes a portion of the thick tube of the second nozzle flow channel 57B.

The third nozzle flow channel plate 119 is a member constituting a portion of the thick tube of the second nozzle flow channel 57B. The second common flow channel plate 120 is a member which constitutes the side walls of the liquid B common flow channel 55B and a portion of the thick tube of the second nozzle flow channel 57B. The second supply port channel plate 121 is a member which constitutes the second supply port 54B and a portion of the thick tube of the second nozzle flow channel 57B. The second pressure chamber plate 122 is a member which constitutes the side walls of the liquid B pressure chamber 52B. The second diaphragm plate 123 is a member sealing the upper surface of the liquid B pressure chamber 52B (forming the ceiling face thereof), and a second actuator 58B is fixed to the upper surface of the second diaphragm plate 123 in a position corresponding to the liquid B pressure chamber 52B.

In each of the actuators 58A and 58B, electrodes (not illustrated) are formed, and the electrodes are connected to a driving circuit (not illustrated), by means of wiring (not illustrated). It is possible to use the first diaphragm plate 117 and the second diaphragm plate 123 as the electrodes.

When a drive voltage is applied between the electrodes of the first actuator 58A, the first actuator 58A deforms, the volume of the liquid A pressure chamber 52A changes, and due to the consequent pressure change, a droplet of ink is ejected from the liquid A ejection nozzle 51A. After ejecting ink, new ink is supplied (replenished) to the liquid A pressure chamber 52A from the liquid A common flow channel 55A, via the supply port 54A.

Similarly, when a drive voltage is applied between the electrodes of the second actuator 58B, the second actuator 58B deforms, the volume of the liquid B pressure chamber 52B changes, and due to the consequent pressure change, a droplet of treatment liquid is ejected from the liquid B ejection nozzle 51B. After ejecting treatment liquid, new treatment liquid is supplied (replenished) to the liquid B pressure chamber 52B from the liquid B common flow channel 55B, via the supply port 54B.

By selectively driving the actuators 58A and 58B corresponding to the nozzles 51A and 51B to be used according to the image data that is to be recorded, it is possible to record a desired image.

Figure 6:
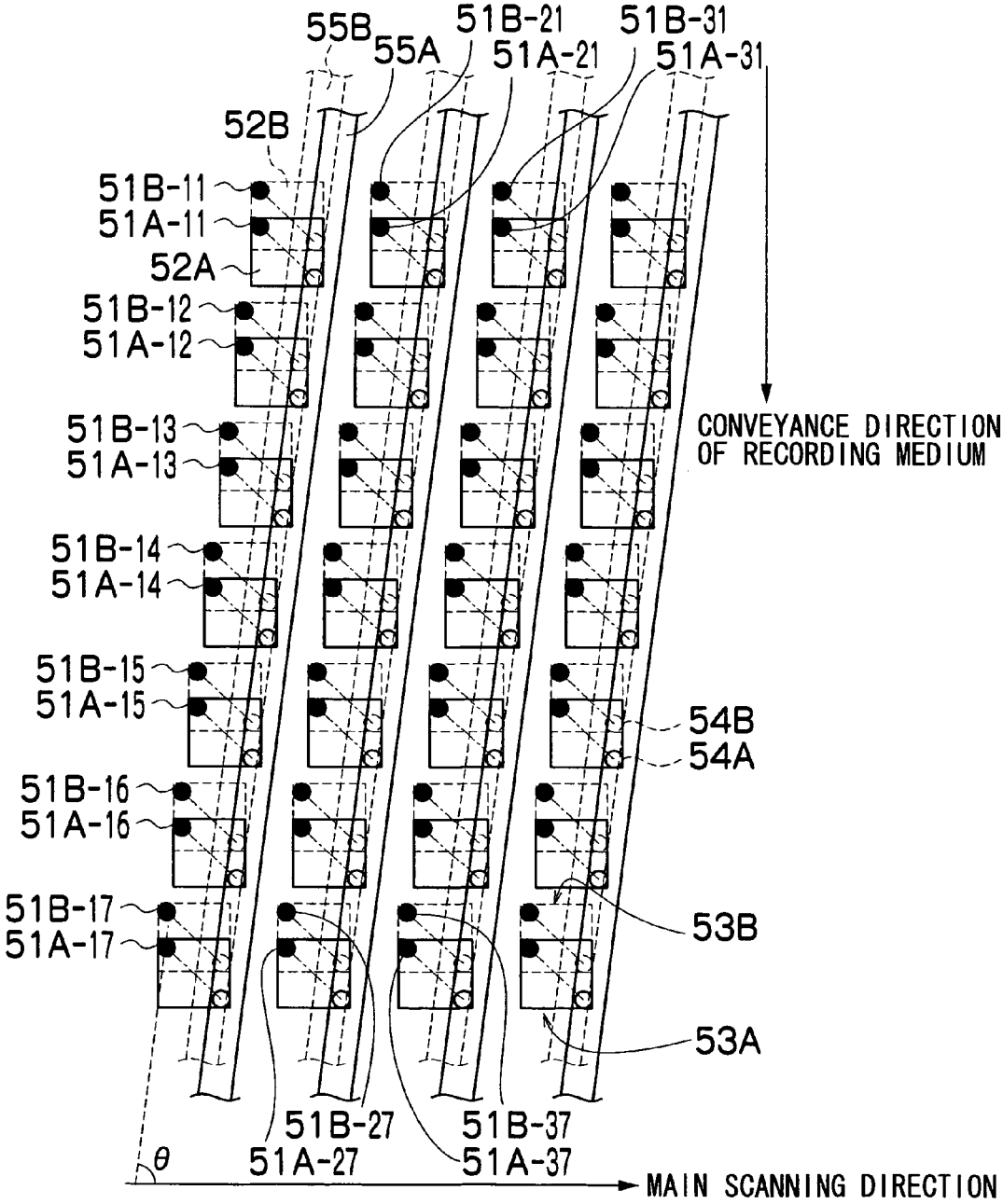
FIG. 6 is a plan view perspective diagram showing the arrangement structure of nozzles and pressure chambers in the print head.

As shown in FIG. 6, the high-density nozzle head according to the present embodiment is achieved by arranging a plurality of ink chamber units 53A and treatment liquid chamber units 53B having the structure illustrated in FIGS. 4 and 5 in a lattice arrangement, based on a fixed arrangement pattern having a row direction which coincides with the lengthwise direction of the head (main scanning direction), and a column direction which is inclined at a fixed angle of θ with respect to the main scanning direction, rather than being perpendicular to the main scanning direction.

In a full-line head comprising nozzle rows that have a length corresponding to the entire width of the image recordable width of the recording medium, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51A, 51B arranged in a matrix such as that shown in FIG. 6 are driven, it is desirable that main scanning is performed in accordance with (3) described above. More specifically, looking in particular at the nozzles for ejecting liquid A 51A-ij (where i is an integer, and j=1, 2, . . . , 7), the nozzles 51A-11, 51A-12, 51A-13, 51A-14, 51A-15, 51A-16, and 51A-17 are taken as one block (and furthermore, nozzles 51A-21, . . . , 51A-27 are taken as one block, nozzles 51A-31, . . . , 51A-37 are taken as one block, and so on), and one line is printed in the breadthways direction of the recording medium by successively driving the nozzles 51A-11, 51A-12, . . . , 51-17 in accordance with the conveyance speed of the recording medium.

On the other hand, "sub-scanning" is defined as to repeatedly perform printing of one line (a line formed of a row of dots, or a line formed of a plurality of rows of dots) formed by the main scanning, while moving the full-line head and the recording medium relatively to each other.

In FIG. 6, similarly, in respect of the nozzles for ejecting liquid B 51B-ij (where i is an integer and j=1, 2, . . . , 7), one line of dots is formed in the breadthways direction of the recording medium by successively driving the nozzles 51B-i1, 51-Bi2, . . . , 51B-i7, from the end of the nozzle block, in accordance with the conveyance speed of the recording medium.

Although not shown in FIG. 6, either end of the common flow channels 55A and 55B are respectively connected to common flow channel main passages (not illustrated) formed inside the print head 50 in line with the lengthwise direction of the print head 50. In other words, each of the common flow channels 55A and 55B shown in FIG. 6 is a branch flow channel, which branches off from a common flow channel main passage (not shown).

As shown in FIG. 6, by arranging the common flow channels 55A and 55B in line with the nozzle rows extending substantially in the sub-scanning direction, the refilling load is not concentrated at a particular common flow channel when the nozzles are driven in main scanning as described above, and hence refilling characteristics are also good. Furthermore, it is also possible to achieve high density by means of a structure in which the common flow channels 55A and 55B are arranged in a layered fashion within the print head 50.

Figure 7:
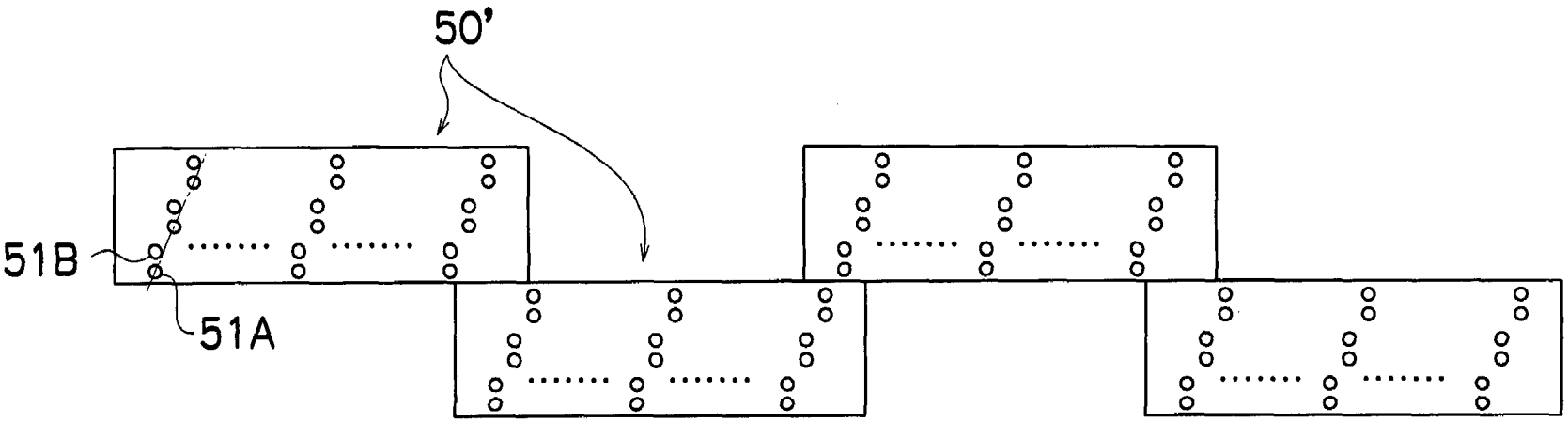
FIG. 7 is a plan diagram showing another example of the composition of a full line head.

When implementing the present invention, the structure of the head and the arrangement of the nozzles is not limited to that of the example illustrated. For example, instead of the composition of an integrated long matrix head illustrated in FIG. 3, a line head having nozzle rows of a length corresponding to the entire length of the recording paper 16 can be formed as shown in FIG. 7 by arranging and combining, in a staggered matrix, short head units 50' each having a plurality of nozzles 51A and 51B arrayed in a two-dimensional fashion. In this case, a structure similar to that shown in FIG. 6 can also be employed for the matrix type nozzle arrangement within each head unit 50'.

Moreover, in the present embodiment, a method is employed in which ink or treatment liquid is ejected by means of the deformation of an actuator 58A or 58B, which is typically a piezoelectric element. However, in implementing the present invention, the method used for ejecting the ink or treatment liquid is not limited in particular, and instead of a piezo method, it is also possible to apply various types of methods, such as a thermal jet method where the ink or treatment liquid is heated and bubbles are caused to form therein by means of a heat generating body such as a heater, droplets of the ink or treatment liquid being ejected by means of the pressure of these bubbles.

Composition of Ink and Treatment Liquid Supply System

Figure 8:
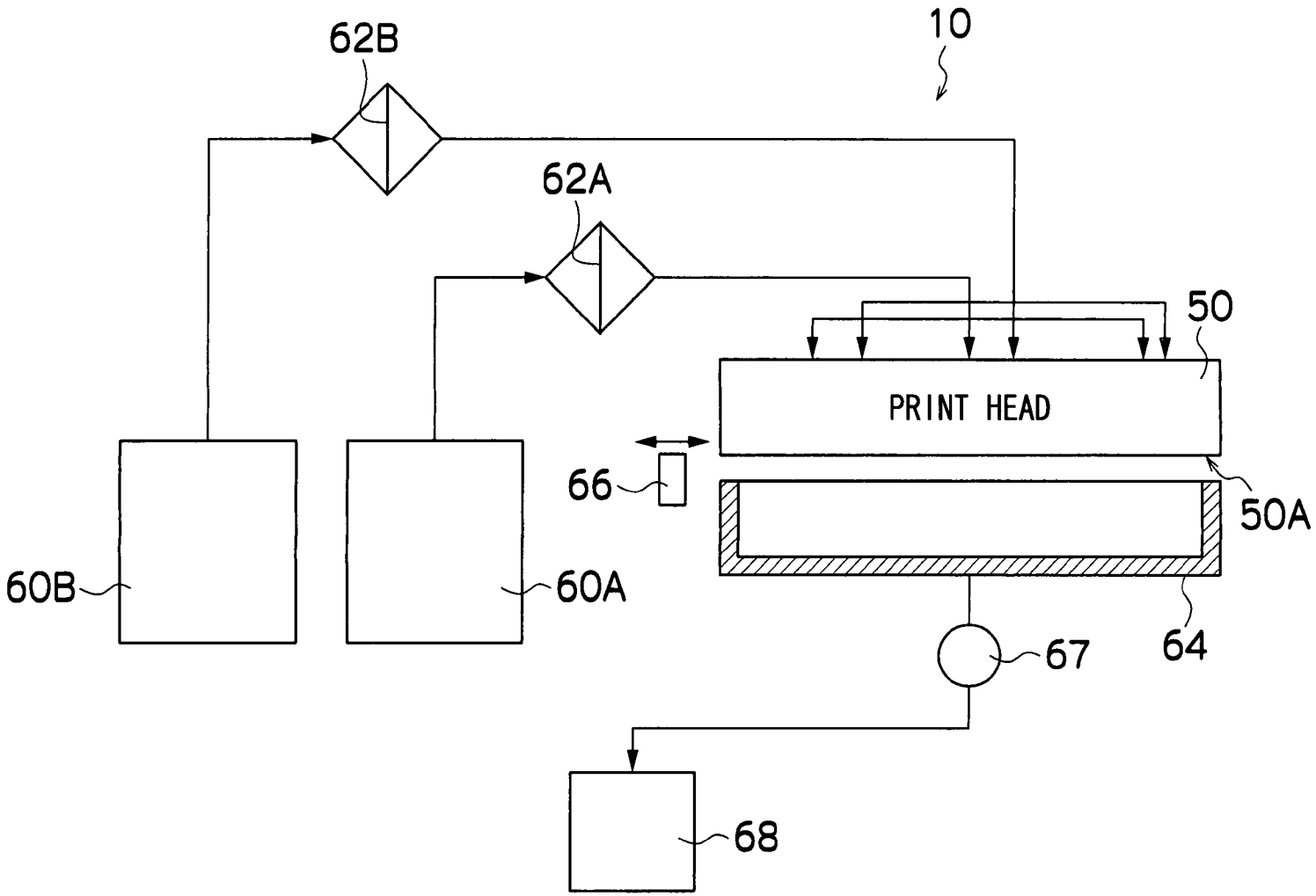
FIG. 8 is a schematic drawing showing the composition of an ink and treatment liquid supply system in the inkjet recording apparatus.

FIG. 8 is a conceptual diagram showing the composition of an ink supply system and a treatment liquid supply system in the inkjet recording apparatus 10. In FIG. 6, the ink tank 60 is a base tank for supplying the ink (liquid A) to the print head 50, which is disposed in the ink storing and loading unit 14 illustrated in FIG. 1. Furthermore, the treatment liquid tank 60B illustrated in FIG. 8 is a base tank for supplying the treatment liquid (liquid B) to the head 50, which is disposed in the treatment liquid storing and loading section 15 illustrated in FIG. 1.

The ink tank 60A and the treatment liquid tank 60B may adopt a system for replenishing ink or treatment liquid by means of a replenishment opening (not illustrated), or a cartridge system wherein cartridges are exchanged independently for each tank, whenever the residual amount of ink or treatment liquid has become low. If the type of ink or the type of treatment liquid is changed in accordance with the type of application, then a cartridge based system is suitable. In this case, desirably, type information relating to the ink or treatment liquid is identified by means of a bar code, or the like, and the ejection of the ink or treatment liquid is controlled in accordance with the identified type. The ink tank 60A and the treatment liquid tank 60B in FIG. 6 are respectively equivalent to the ink storing and loading unit 14 and the treatment liquid storing and loading unit 15 shown in FIG. 1 and described above.

As shown in FIG. 8, a filter 62A is provided between the ink tank 60A and the print head 50, in order to remove foreign matter and air bubbles. Furthermore, a filter 62B is provided between the treatment liquid tank 60B and the print head 50 in order to remove foreign matter and air bubbles. The mesh size in the filters 62A and 62B is preferably equivalent to or less than the diameter of the nozzle and commonly it is about 20 μm. Although not shown in FIG. 8, desirably, a composition is adopted in which a subsidiary tank is provided in the vicinity of the head 50, or in an integrated manner with the head 50. The subsidiary tank has the function of improving damping effects and refilling, in order to prevent variations in the internal pressure inside the head.

The inkjet recording apparatus 10 is also provided with a cap 64 as a device to prevent the nozzles 51A and 51B from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face 50A is thereby covered with the cap 64.

The cleaning blade 66 is composed of rubber or another elastic member, and can slide on the ink ejection surface (surface of the nozzle plate) of the head 50 by means of a blade movement mechanism (not shown). If there are ink droplets, treatment liquid droplets or foreign matter adhering to the nozzle surface 50A, then the nozzle surface 50A is wiped by causing the cleaning blade 66 to slide over the nozzle surface 50A, thereby cleaning the nozzle plate surface. This wiping action is performed by sliding the cleaning blade 66 in the row direction of the nozzle arrangement illustrated in FIG. 3, in other words, in the lengthwise direction of the print head.

During printing or during standby, if the use frequency of a particular nozzle has declined and the viscosity or the liquid (ink or treatment liquid) in the vicinity of the nozzle has increased, then a preliminary ejection is performed onto the cap 64, in order to remove the degraded ink or the degraded treatment liquid.

Furthermore, if air bubbles have mixed into the ink or treatment liquid inside the print head 50 (namely, into the pressure chambers 52A or the pressure chambers 52B), then the cap 64 is placed against the head 50, and the liquid (namely, the liquid containing air bubbles) inside the pressure chambers 52A and 52B is removed by suctioning by means of the suction pump 67, the liquid thus removed being conveyed to a collection tank 68. This suction operation is also carried out in order to remove degraded ink or degraded treatment liquid having increased viscosity (namely, hardened ink or treatment liquid), when ink or treatment liquid is loaded into the print head 50 for the first time, and when the print head 50 starts to be used again after having been out of use for a long period of time.

When a state in which ink is not ejected from the print head 50 continues for a certain amount of time or longer, the solvent in the vicinity of the nozzles evaporates and ink viscosity increases. In such a state, ink can no longer be ejected from the nozzles 51A even if the actuators 58A for driving ejection are operated. Similarly in respect of the nozzles 51B for ejecting treatment liquid, if the nozzles do not perform ejection for a long period of time, then it becomes impossible to eject the treatment liquid which has increased in viscosity. Therefore, before reaching such a state, the actuators 58A and 58B are operated toward an ink receptacle (here, as which the cap 64 is also serves) in a viscosity range that allows liquid to be ejected by the operation of the actuators 58A and 58B, and a "preliminary ejection" is thereby performed which causes the liquid in the vicinity of the nozzle of which viscosity has increased to be ejected. Furthermore, after cleaning away soiling on the surface of the nozzle plate by means of a wiper, such as the cleaning blade 66, provided as the cleaning device on the nozzle surface 50A, a preliminary ejection is also carried out in order to prevent mixing of foreign matter inside the nozzles 51A and 51B due to the rubbing action of the wiper. The preliminary ejection is also referred to as "dummy ejection", "purge", "liquid ejection", and so on.

When bubbles have become intermixed in the nozzles 51A and 51B or the pressure chambers 52A and 52B, or when the liquid viscosity inside the nozzles 51A and 51B has increased over a certain level, the liquid can no longer be ejected by the preliminary discharge, and a suctioning action is carried out as follows.

More specifically, when bubbles have become intermixed in the ink inside the nozzles 51A and 51B and the pressure chambers 52A and 52B, the liquid can no longer be ejected from the nozzles 51A and 51B even if the actuators 58A and 58B is operated. Also, when the liquid viscosity inside the nozzles 51A and 51B has increased over a certain level, the liquid can no longer be ejected from the nozzles 51A and 51B even if the actuator 58 is operated. In these cases, a suctioning device to remove the liquid inside the pressure chambers 52A and 52B by suction with a suction pump, or the like, is placed on the nozzle face 50A of the head 50, and the liquid in which bubbles have become intermixed or the liquid of which viscosity has increased is removed by suction.

However, since this suction action is performed with respect to all the liquid in the pressure chambers 52A and 52B, the consumption amount of ink and treatment liquid is considerable. Therefore, a preferred aspect is one in which a preliminary discharge is performed while the increase in the viscosity of the liquid is small.

Description of Control System

Figure 9:
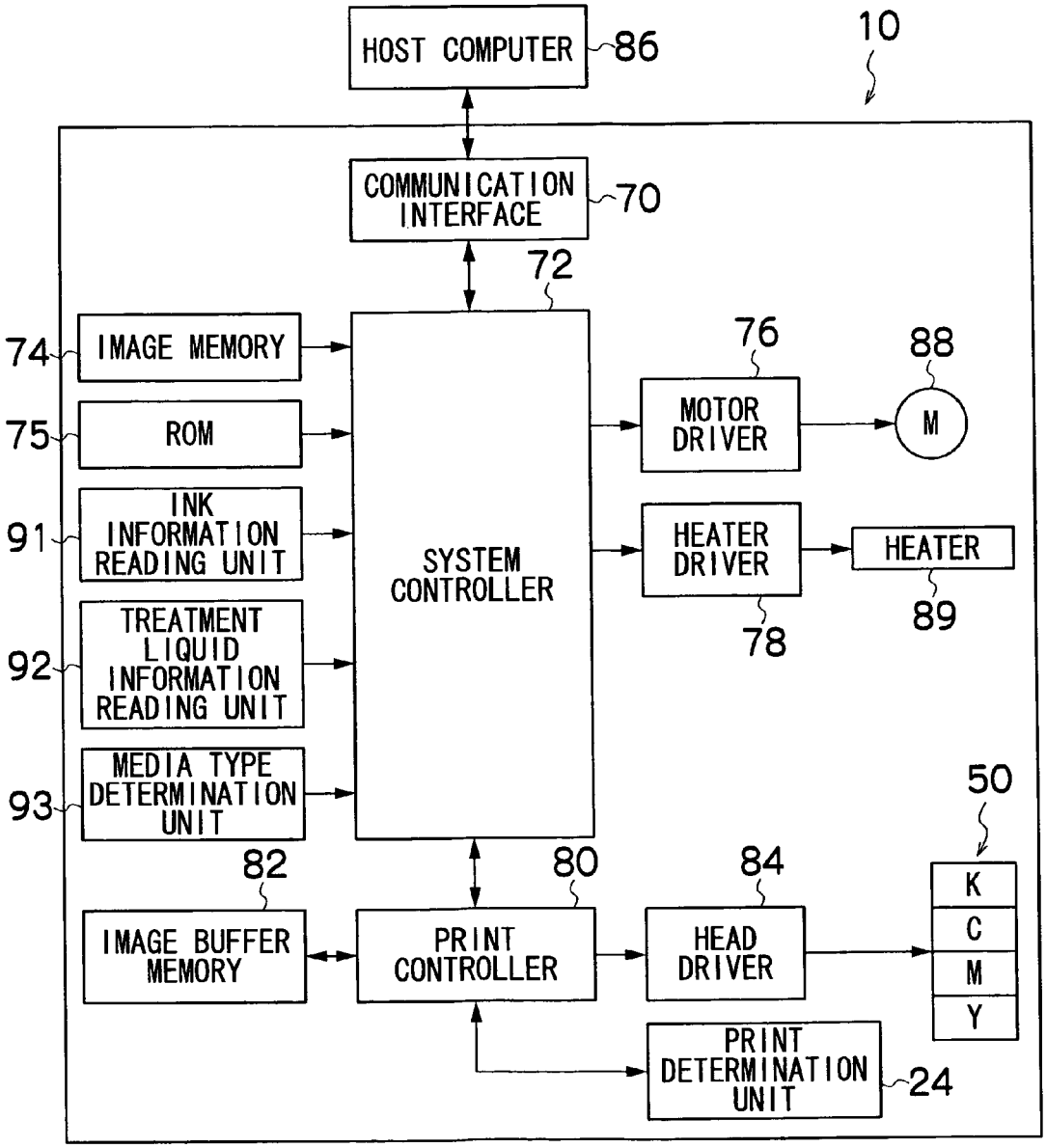
FIG. 9 is a principal block diagram showing the system composition of the inkjet recording apparatus.

FIG. 9 is a principal block diagram showing the system configuration of the inkjet recording apparatus 10. The inkjet recording apparatus 10 comprises a communication interface 70, a system controller 72, an image memory 74, a ROM 75, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the ROM 75. The ROM 75 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink and the treatment liquid are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 9 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58A and 58B of the heads 50 of the respective colors 12K, 12C, 12M and 12Y on the basis of print data supplied by the print controller 80. The head driver 84 can be provided with a feedback control system for maintaining constant drive conditions for the print heads.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color by a half-toning technique, such as dithering or error diffusion, in the print controller 80. In this inkjet recording apparatus 10, an image which appears to have a continuous tonal gradation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible.

In other words, the print controller 80 performs processing for converting the inputted RGB image data into dot data for four colors, K, C, M and Y. The dot data generated by the print controller 80 is stored in the image buffer memory 82.

The head driver 84 generates drive control signals for the head 50 on the basis of the dot data stored in the image buffer memory 82. By supplying the drive control signals generated by the head driver 84 to the head 50, ink is ejected from the head 50. By controlling ejection of ink and treatment liquid from the heads 50 in synchronization with the conveyance velocity of the recording paper 16, an image is formed on the recording paper 16.

The print determination unit 24 is a block that includes the line sensor as described above with reference to FIG. 1, reads the image printed on the recording paper 16, determines the print conditions (presence of the ejection, variation in the dot formation, optical density, and the like) by performing desired signal processing, or the like, and provides the determination results of the print conditions to the print controller 80.

According to requirements, the print controller 80 makes various corrections with respect to the head 50 on the basis of information obtained from the print determination unit 24. Furthermore, the system controller 72 implements control for carrying out preliminary ejection, suctioning, and other prescribed restoring processes on the head 50, on the basis of the information obtained from the print determination unit 24.

In addition, the inkjet recording apparatus 10 according to this embodiment has an ink information reading unit 91, a treatment liquid information reading unit 92 and a media type determination unit 93. The ink information reading unit 91 is a device for reading in information relating to the ink type. More specifically, it is possible to use, for example, a device which reads in ink properties information from the shape of the cartridge in the ink tank 60A (a specific shape which allows the ink type to be identified), or from a bar code or IC chip incorporated into the cartridge. Besides this, it is also possible for an operator to input the required information by means of a user interface.

Similarly, the treatment liquid information reading unit 92 is a device for acquiring information relating to the type of treatment liquid. More specifically, it is possible to use, for example, a device which reads in treatment liquid properties information from the shape of the cartridge in the treatment liquid tank 60B (a specific shape which allows the liquid type to be identified), or from a bar code or IC chip incorporated into the cartridge. Besides this, it is also possible for an operator to input the required information by means of a user interface.

The media type determination unit 93 is a device for determining the type and size of the recording medium. This section uses, for example, a device for reading in information such as bar codes attached to the magazine 32 in the media supply unit 22, or sensors disposed at a suitable position in the paper conveyance path (a paper width determination sensor, a sensor for determining the thickness of the paper, a sensor for determining the reflectivity of the paper, and so on). A suitable combination of these elements may also be used. Furthermore, it is also possible to adopt a composition in which information relating to the paper type, size, or the like, is specified by means of an input via a prescribed user interface, instead of or in conjunction with such automatic determining devices.

The information acquired from the various devices, namely, the ink information reading unit 91, the treatment liquid information reading unit 92 and the media type determination unit 93 is sent to the system controller 72, where it is used to control ejection of the ink and treatment liquid (namely, to control the ejection volume and ejection timing), in such a manner that suitable droplet ejection is performed in accordance with the conditions.

Control of Ejection Driving

In the inkjet recording apparatus 10 having a composition of this kind, the supply of electrical power to the first actuators 58A and the second actuators 58B is controlled in a substantially simultaneous fashion to the pair of actuators 58A and 58B corresponding to the first nozzle 51A and the second nozzle 51B that are aligned adjacently in the sub-scanning direction. In other words, a drive waveform is supplied in parallel to the pair of actuators 58A and 58B that correspond to the first nozzle 51A and the second nozzle 51B that are aligned adjacently in the sub-scanning direction.

Figure 10A:
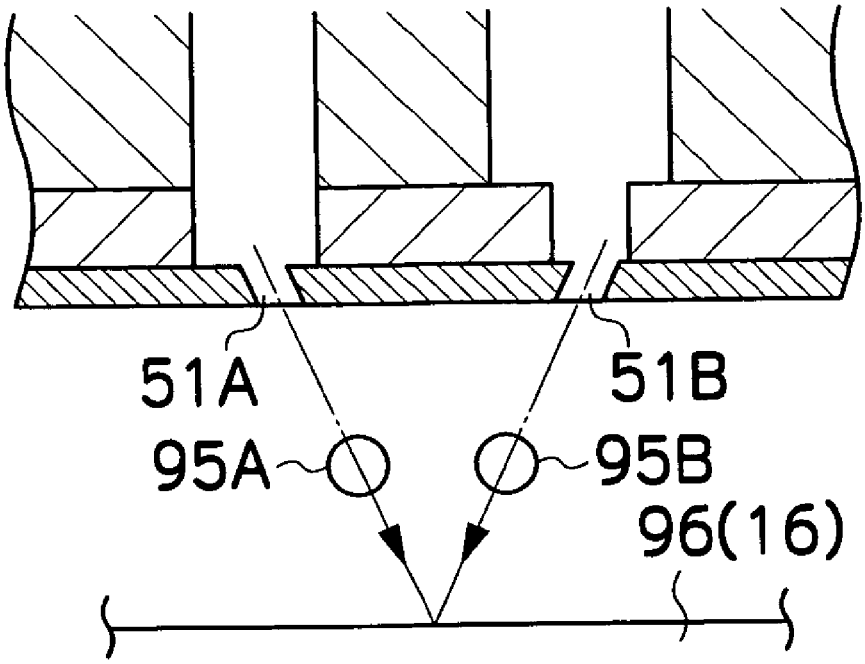
FIGS. 10A and 10B are schematic diagrams for explaining a liquid ejection operation from the print head.
Figure 10B:
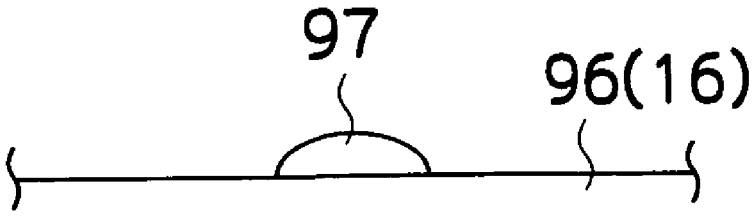

In this way, two types of liquid droplets 95A and 95B are ejected substantially simultaneously from the two nozzles 51A and 51B, as illustrated in FIG. 10A. The two liquid droplets 95A and 95B ejected simultaneously in this manner land at substantially the same timing in substantially the same location on the recording medium 96 (which corresponds to the recording paper 16 in FIG. 1), and as illustrated in FIG. 10B, they combine on the recording medium 96 to form one dot 97. If the dot size is to be changed, then the first actuator 58A and the second actuator 58B are controlled in conjunction with each other, and the ejection volume of both liquids is controlled, as a pair.

In this way, by using a common drive waveform for the actuators 58A and 58B, it is possible to simplify the driver circuit.

If it is necessary to be able to vary the mixture ratio of the liquid A and liquid B in accordance with the image data, or other conditions, then a composition which generates drive waveforms independently for the first actuator 58A and the second actuator 58B is adopted.

Second Embodiment

Next, a second embodiment of the present invention will be described.

Figure 11:
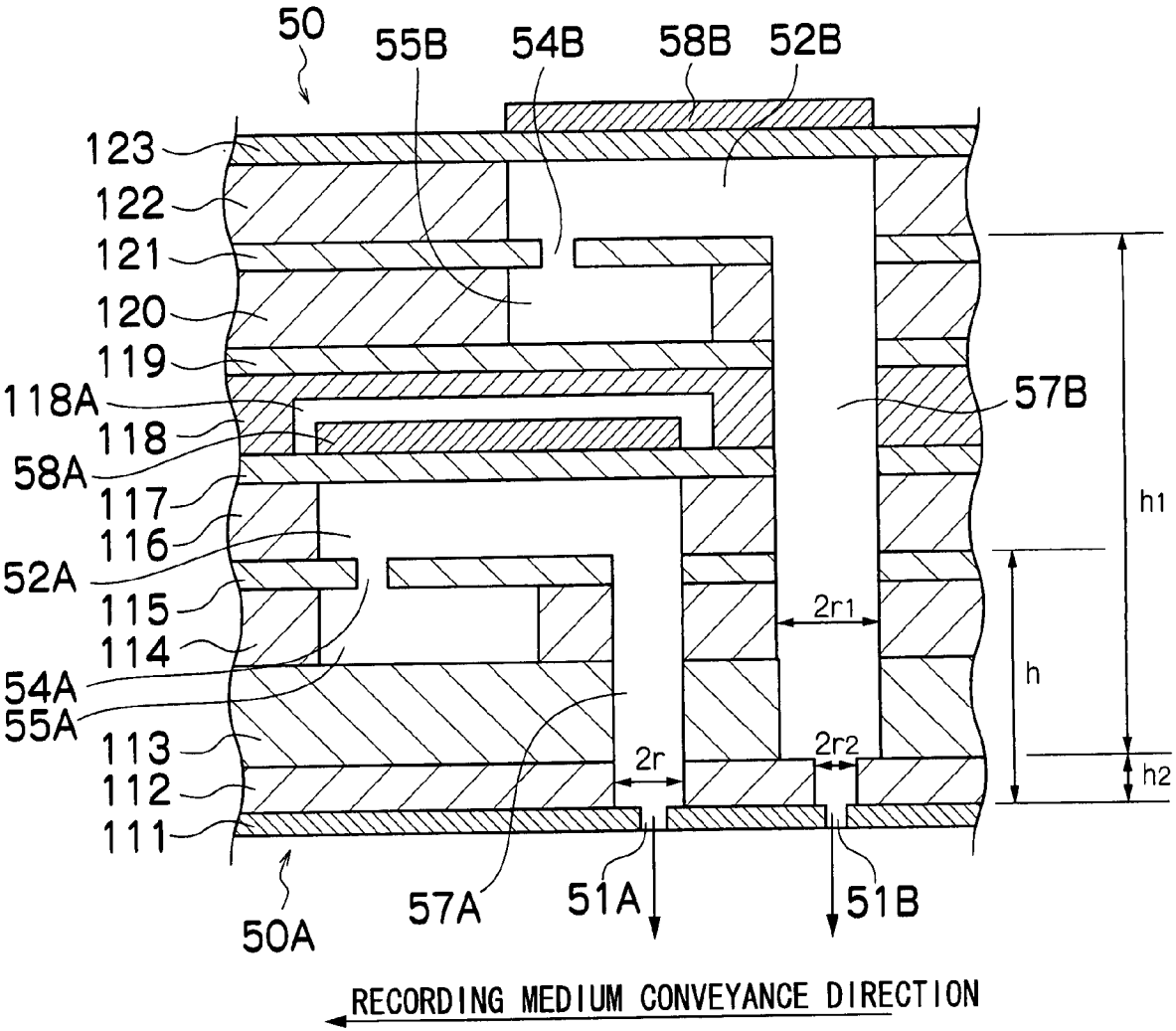
FIG. 11 is a principal part cross-sectional diagram showing the internal structure of a print head according to a second embodiment of the present invention.

The composition illustrated in FIG. 11 may also be adopted, instead of the structure of the print head 50 shown in FIG. 5. In FIG. 11, items which are the same as or similar to those in FIG. 5 are denoted with the same reference numerals and description thereof is omitted here.

In the example shown in FIG. 11, a composition is adopted in which the liquid droplets are propelled in a substantially perpendicular direction with respect to the recording medium, rather than inclining the ejection directions of the nozzles 51A and 51B. The arrangement configuration of the nozzles 51A and 51B is similar to that illustrated in FIGS. 2 and 6.

According to the configuration illustrated in FIG. 11, taking the conveyance speed of the recording medium to be U, and the distance between the nozzles 51A and 51B to be $L_{AB}$, the time difference between the landing times of the liquid ejected from the nozzles 51A and 51B is $L_{AB}/U$, in such a manner that the liquid droplets land in substantially the same position on the recording medium.

A composition in which the liquid A and the liquid B are caused to land on the recording medium at a slight time difference apart is desirable in a case where an ink containing a coloring material (liquid A) and a treatment liquid (liquid B) containing a reaction promoting agent are used.

As shown in FIG. 11, by ejecting a reaction agent (liquid B) from a nozzle 51B positioned on the upstream side of the print head 50 with respect to the conveyance direction of the recording medium, and ejecting a coloring material (liquid A) from a nozzle 51A positioned on the downstream side, the reaction promoting agent lands first on the recording medium, and after a slight time difference, the coloring material lands on the dot of reaction promoting agent on the recording medium.

In other words, the coloring material always lands on the reaction promoting agent and does not land directly on the recording medium. The coloring material landing on the droplet of the reaction promoting agent mixes with the reaction promoting agent upon landing, and immediately starts a fixing reaction. Thereby, it is possible to prevent bleeding of the dot created by the coloring material.

Even though the reaction promoting agent lands directly on the recording medium and permeates into the recording medium, since the reaction promoting agent does not contain any coloring material, it does not cause any problem in terms of giving rise to bleeding.

Third Embodiment

Next, a third embodiment of the present invention will be described.

Figure 12:
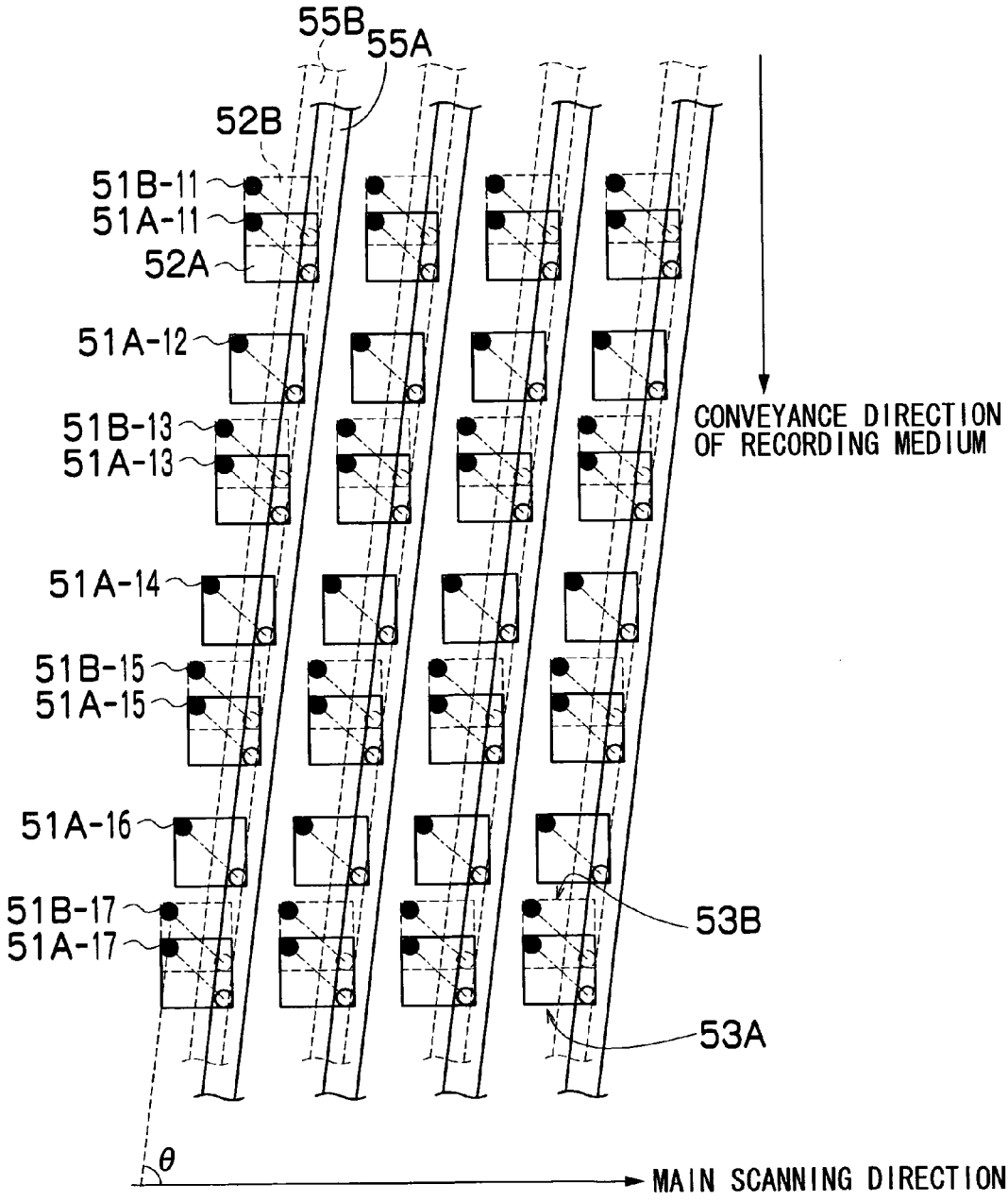
FIG. 12 is a plan view perspective diagram showing the arrangement structure of nozzles and pressure chambers in a print head according to a third embodiment of the present invention.

Instead of the arrangement structure of the nozzles 51A and 51B, and the pressure chambers 52A and 52B described in FIG. 6, it is also possible to adopt an arrangement structure in which the number of nozzles 51B for ejecting liquid B is less than the number of nozzles 51A for ejecting liquid A as shown in FIG. 12. In FIG. 12, items which are the same as or similar to those in FIG. 6 are denoted with the same reference numerals and description thereof is omitted here.

In the example in FIG. 12, the liquid B ejection nozzles 51B are disposed at every alternate row of liquid A ejection nozzles 51A in the sub-scanning direction with respect to the two-dimensional arrangement of liquid A ejection nozzles 51A (in other words, liquid B ejection nozzles 51B are arranged only at the odd-numbered rows in the sub-scanning direction).

In this case, a composition is adopted whereby the droplet ejection regions of two dots deposited by two liquid A ejection nozzles 51A-ik and 51A-im (where i is an integer, k=1, 3, 5, and m=k+1) at downstream positions are covered by dots deposited by one liquid B ejection nozzle 51B-ik located on the upstream side thereof in the conveyance direction of the recording medium.

Figure 13:
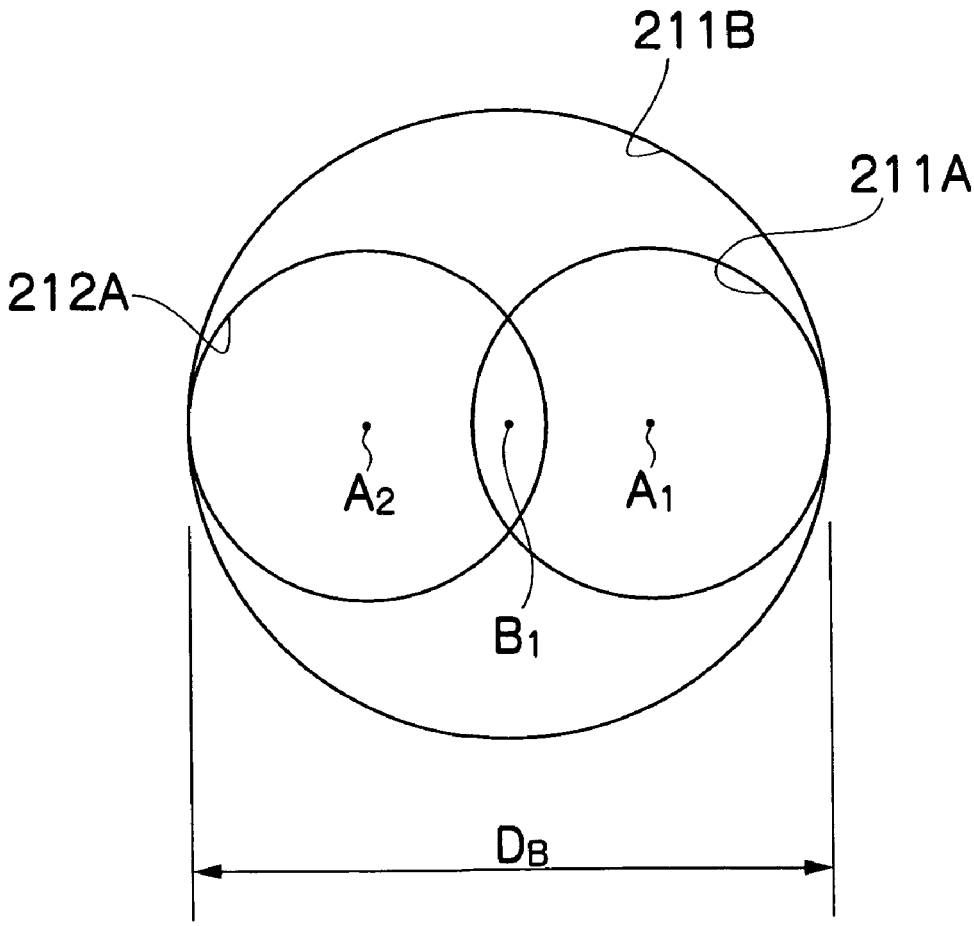
FIG. 13 is a schematic diagram showing an example of a dot arrangement in a case where droplet ejection is performed by the print head shown in FIG. 12.

FIG. 13 shows an example of this dot arrangement. In the diagram, the reference numerals 211A and 212A indicate dots which are respectively deposited by the liquid A ejection nozzles 51A-11 and 51A-12 in FIG. 12, and reference numeral 211B in FIG. 13 indicates a dot deposited by the liquid B ejection nozzle 51B-11 in FIG. 12.

The liquid B ejection nozzles 51B-11 previously deposits the dot 211B at a slight time difference before the dots 211A and 212A deposited by the nozzle 51A-11 and the nozzle 51A-12. The dot size $D_B$ of the dot 211B is set to value whereby the dot has a surface area to cover the droplet ejection region (dot coverage region) of the dot 211A and the dot 211B of liquid A.

Thereby, the deposited droplets forming dot 211A and dot 212A which contain coloring material react immediately with the reaction promoting agent in dot 211B, and hence a fixing reaction starts.

Figure 14:
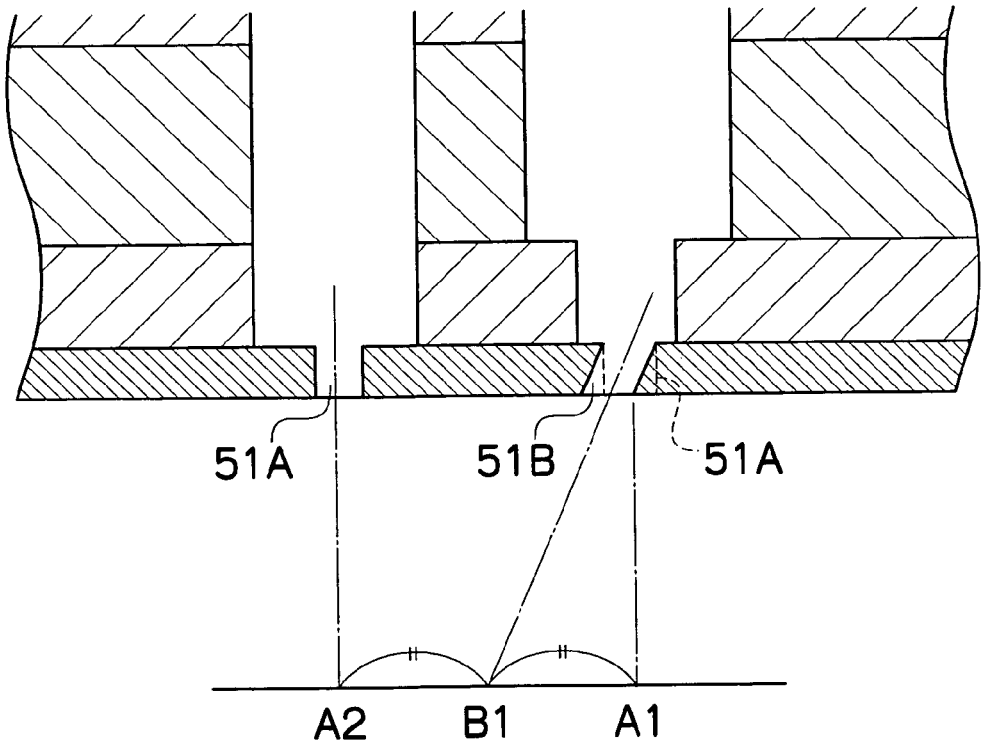
FIG. 14 is a cross-sectional diagram of the nozzle section of the print head shown in FIG. 12.

In the dot arrangement shown in FIG. 13, the central point B1 of the dot 211B is situated in the approximate center of the line A1-A2 linking the centers of the dots 211A and 212A. In one example of a composition for obtaining a dot arrangement of this kind, as shown in FIG. 14, for example, the liquid A ejection nozzles 51A are composed so as to propel the liquid droplets in a substantially perpendicular direction with respect to the recording medium, rather than inclining the ejection directions, and the liquid B ejection nozzles 51B are set to a nozzle inclination angle whereby the ejected liquid lands at a central position B1 between the dots formed by the droplets ejected from the liquid A ejection nozzles 51A.

Furthermore, in this third embodiment, droplet ejection is controlled in such a manner that a dot 211B is deposited only when at least one of the dots 211A and 212A is to be deposited. By omitting unnecessary formation of dots of liquid B which do not contribute to a reaction, it is possible to reduce the consumption of liquid B.

Fourth Embodiment

Next, a fourth embodiment of the present invention will be described.

Figure 15:
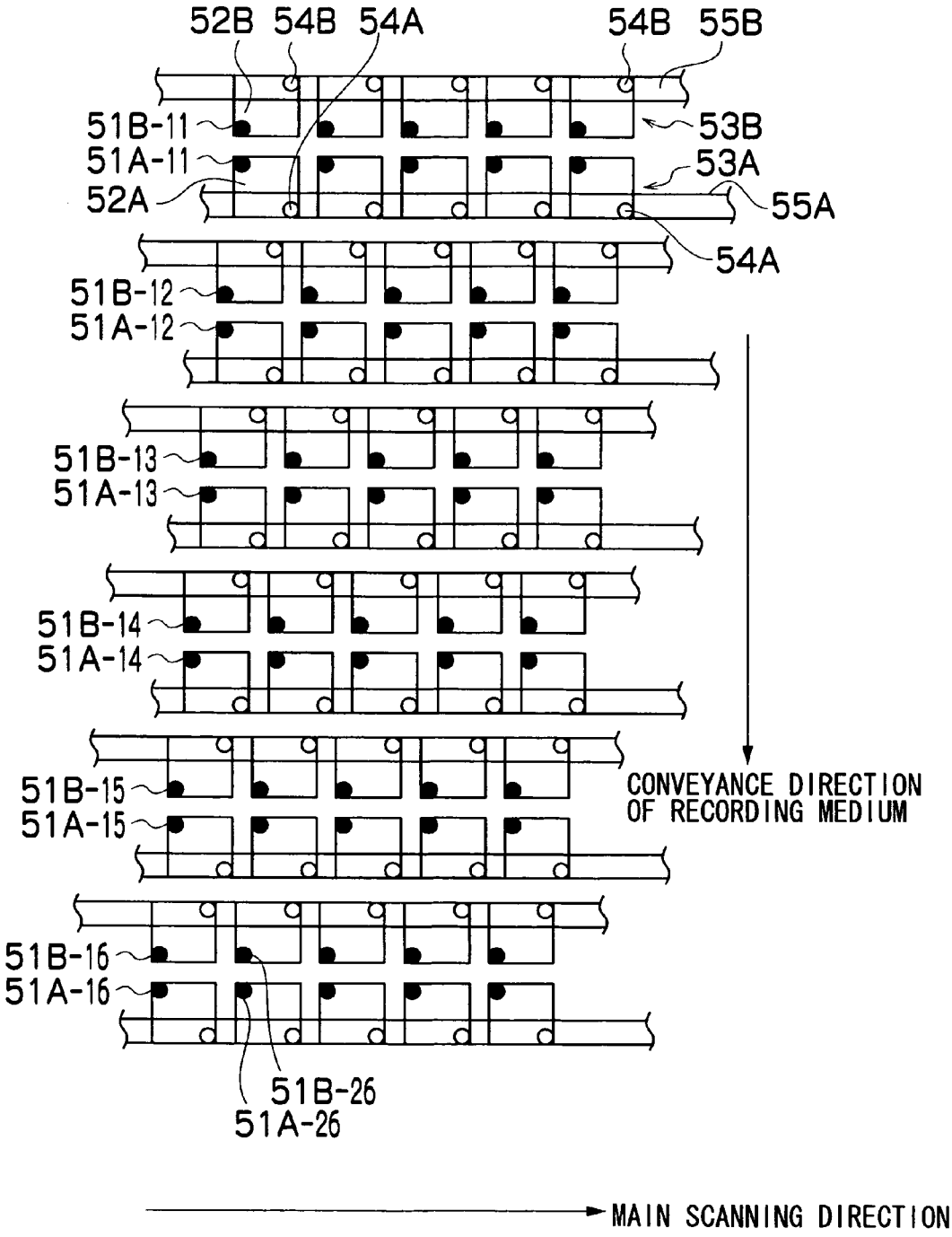
FIG. 15 is a plan view perspective diagram showing the arrangement structure of nozzles and pressure chambers in a print head according to a fourth embodiment of the present invention.

FIG. 15 is a plan view perspective diagram showing the principal part of an example of the structure of a print head according to a fourth embodiment of the present invention. In this diagram, items which are the same as or similar to the composition in FIG. 6 are denoted with the same reference numerals and description thereof is omitted here.

The embodiment shown in FIG. 15 has a structure in which the liquid A pressure chambers 52A and the liquid B pressure chambers 52B are arranged in a planar fashion, without overlapping with each other. A planar structure of this kind makes the manufacturing process easier compared to the case of a layered structure as illustrated in FIG. 6.

A liquid A ejection nozzle 51A-ij and a liquid B ejection nozzle 51B-ij are aligned in mutually adjacent positions in the sub-scanning direction (the conveyance direction of the recording medium).

This composition is similar to the embodiment shown in FIG. 6 in that a nozzle 51A-ij or 51B-ij and a supply port 54A or 54B are arranged on a diagonal of each pressure chamber 52A, 52B, which has an approximately square planar shape. Here, in the case of the fourth embodiment shown in FIG. 15, common flow channels 55A and 55B are disposed following the nozzle rows extending in the main scanning direction (lengthwise direction of the print head). This composition simplifies the manufacturing process, since it does not require a layered structure to be adopted for the common flow channels 55A and 55B.

Fifth Embodiment

Next, a fifth embodiment of the present invention will be described.

Figure 16:
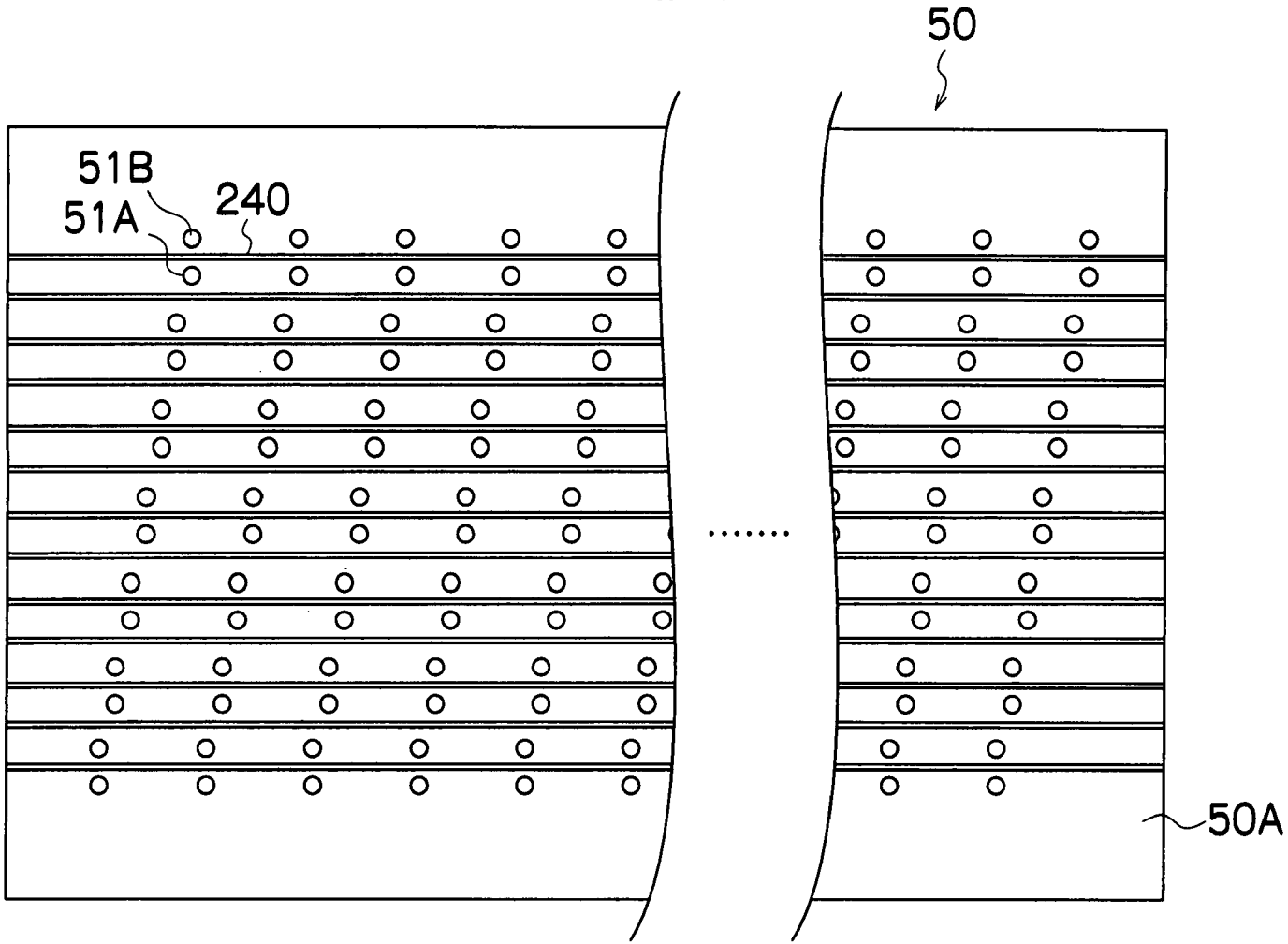
FIG. 16 is a plan diagram showing the nozzle surface of a print head according to a fifth embodiment of the present invention.
Figure 17:
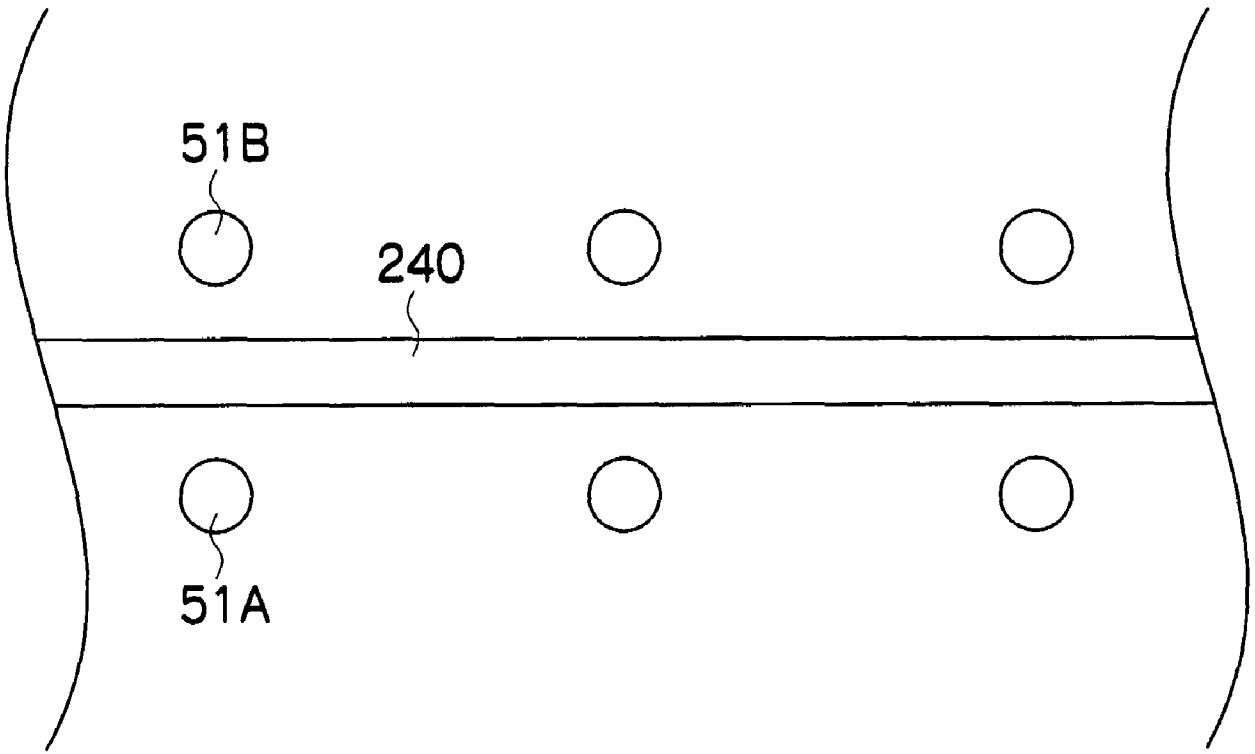
FIG. 17 is an enlarged diagram of the nozzle surface of the print head shown in FIG. 16.
Figure 18:
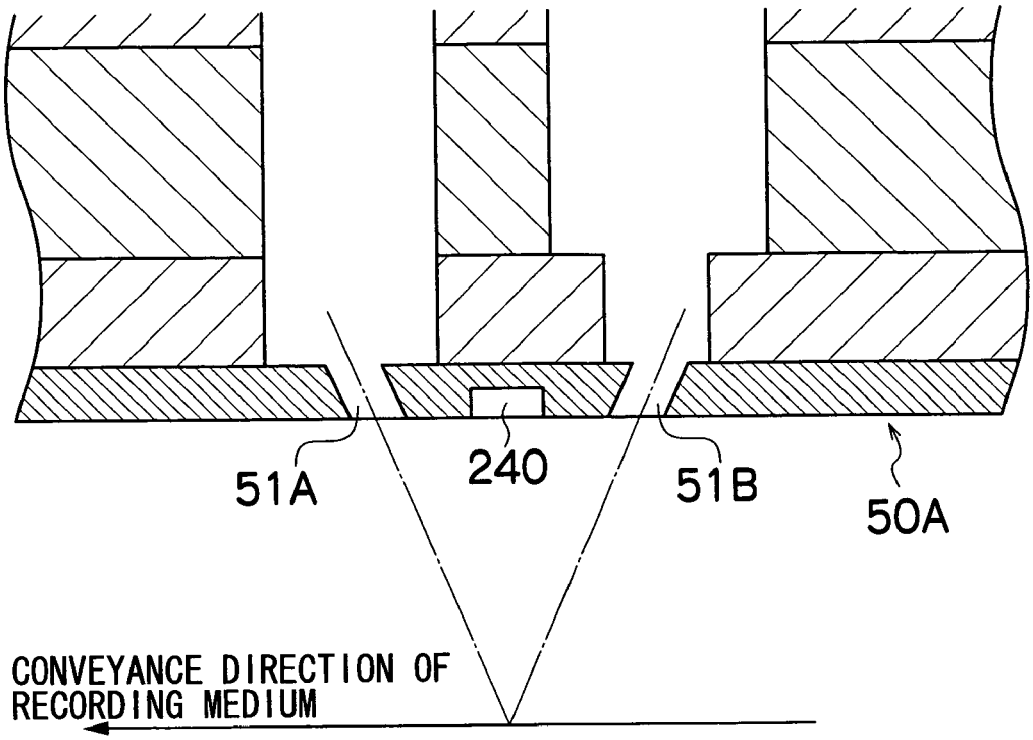
FIG. 18 is a cross-sectional diagram of the nozzle section of the print head shown in FIG. 16.

FIG. 16 is a plan diagram showing the nozzle surface of a print head according to a fifth embodiment; FIG. 17 is an enlarged diagram of FIG. 16; and FIG. 18 is a cross-sectional diagram of a principal part thereof. In these drawings, items which are the same as or similar to the composition in FIGS. 3 to 6 are denoted with the same reference numerals and description thereof is omitted here.

As shown in FIGS. 16 to 18, grooves 240 parallel to the lengthwise direction of the head (the wiping direction of the cleaning blade 66 illustrated in FIG. 8) are formed on the nozzle surface 50A of the print head 50, at the boundaries between the liquid A ejection nozzles 51A and the liquid B ejection nozzles 51B.

As described previously, wiping is performed by sliding the cleaning blade 66 in the row direction of the nozzle arrangement (the lengthwise direction of the print head). The liquid adhering to the nozzle surface 50A moves over the nozzle surface 50A due to the wiping action, but if two different types of liquid enter into the nozzle apertures, then a combined reaction of the liquids will occur.

In order to avoid situations of this kind, the grooves 240 are provided as a device for preventing mixture of the liquids, (in other words, a device for restricting the range of movement of the liquids), between the liquid A ejection nozzles 51A and the liquid B ejection nozzles 51B. Instead of the grooves 240 or in conjunction with same, it is also possible to provide projection-shaped dividing members (not illustrated), for example.

FIGS. 16 to 18 show an example in which the grooves 240 for preventing mixture are appended to the head composition illustrated in FIGS. 3 to 6, but similarly, it is also possible to adopt a composition in which a mechanism for preventing mixture of the two liquids via the nozzle surface 50A (groove, or dividing members) is appended to the head compositions illustrated in FIGS. 11 to 15.

In the foregoing embodiments, the reaction promoting agent has been described as an example of a treatment liquid, but a mode is also possible in which a permeation retarding agent is used instead of a reaction promoting agent. The permeation retarding agent has a function of delaying the progress of permeation of the ink into the recording medium, by combining with the ink (liquid A) containing coloring material. This is suitable for use in the case of a recording medium such as standard paper, in which the liquid permeates while diffusing in the planar direction within the medium, and which is therefore liable to bleeding.

Moreover, in the foregoing explanation, an inkjet recording apparatus has been described as one example of an image forming apparatus, but the scope of application of the present invention is not limited to this. For example, the liquid droplet ejection head according to the present invention may also be applied to a photographic image forming apparatus in which developing solution is applied onto a printing paper by means of a non-contact method. Furthermore, the scope of application of the liquid droplet ejection head according to the present invention is not limited to an image forming apparatus, and the present invention may also be applied to various other types of apparatuses which spray a processing liquid, or other liquid, toward an ejection receiving medium by means of an ejection head (such as a coating device, wiring pattern printing device, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet ejection head, comprising:

first nozzles which eject droplets of a first liquid to an ejection receiving medium;

second nozzles which eject droplets of a second liquid to the ejection receiving medium, wherein the first nozzles and the second nozzles are arranged to cover the full width of the ejection receiving medium;

first pressure chambers which are connected to the first nozzles and filled with the first liquid to be ejected from the first nozzles;

first pressure generating devices which cause the first liquid to be ejected from the first nozzles by applying pressure to the first liquid inside the first pressure chambers;

second pressure chambers which are connected to the second nozzles and filled with the second liquid to be ejected from the second nozzles;

second pressure generating devices which cause the second liquid to be ejected from the second nozzles by applying pressure to the second liquid inside the second pressure chambers; and a nozzle plate in which the first nozzles and the second nozzles are formed, wherein the first nozzles and the second nozzles are arranged in a two-dimensional array and disposed adjacently in mutual proximity so as to be aligned in a sub-scanning direction which is parallel to a relative direction of movement of the ejection receiving medium and the liquid droplet ejection head, in such a manner that the first liquid and the second liquid ejected respectively from the first nozzle and the second nozzle that are arranged in mutual proximity are deposited at substantially same position on the ejection receiving medium, wherein the first pressure chambers and the second pressure chambers are arranged in a layered structure, in such a manner that the first pressure chambers and the second pressure chambers in different layers partially overlap with each other and non-overlapping regions thereof are aligned in the sub-scanning direction, wherein the first liquid having a relatively high viscosity is filled into the first pressure chambers formed in a layer which is nearer to the nozzle plate, and the second liquid having a relatively low viscosity is filled into the second pressure chambers formed in a layer which is further from the nozzle plate.

2. The liquid droplet ejection head as defined in claim 1, wherein:

the first pressure chambers and the second pressure chambers are formed to have an approximately square planar shape;

each of the first pressure chambers has a nozzle connection port for directing the first liquid to the first nozzle, and a supply port for introducing the first liquid into the first pressure chamber, the nozzle connection port and the supply port being disposed on a diagonal of the approximately square planar shape; and each of the second pressure chambers has a nozzle connection port for directing the second liquid to the second nozzle, and a supply port for introducing the second liquid into the second pressure chamber, the nozzle connection port and the supply port being disposed on a diagonal of the approximately square planar shape.

3. The liquid droplet ejection head as defined in claim 1, wherein a first nozzle inclination angle which defines a direction of ejection of the first liquid from the first nozzles, and a second nozzle inclination angle which defines a direction of ejection of the second liquid from the second nozzles are set in such a manner that the droplet of the first liquid ejected from the first nozzle and the droplet of the second liquid ejected from the second nozzle are propelled toward substantially the same position on the ejection receiving medium.

4. The liquid droplet ejection head as defined in claim 1, wherein a cross-sectional area and length of first nozzle side flow channels leading from the first pressure chambers to the first nozzles, and a cross-sectional area and length of second nozzle side flow channels leading from the second pressure chambers to the second nozzles are set in such a manner that a ratio between an ejected volume of the first liquid ejected from the first nozzles and an ejected volume of the second liquid ejected from the second nozzles is a prescribed value.

5. The liquid droplet ejection head as defined in claim 1, wherein:

the first nozzles and the second nozzles are arranged two-dimensionally so as to be aligned in a row direction which is substantially parallel to a main scanning direction that is perpendicular to the relative direction of movement of the ejection receiving medium and the liquid droplet ejection head, and in a column direction which extends substantially in the sub-scanning direction, being oblique to the row direction at a prescribed angle; and a first common flow channel which supplies the first liquid to the first pressure chambers corresponding to the first nozzles aligned in the column direction, and a second common flow channel which supplies the second liquid to the second pressure chambers corresponding to the second nozzles aligned in the column direction, are formed in line with nozzle rows aligned in the column direction.

6. The liquid droplet ejection head as defined in claim 1, wherein a first common flow channel which supplies the first liquid to the first pressure chambers and a second common flow channel which supplies the second liquid to the second pressure chambers are arranged in a layered structure, in such a manner that the first common flow channel and the second common flow channel in different layers partially overlap with each other.

7. The liquid droplet ejection head as defined in claim 1, wherein the first liquid contains a coloring material, and the second liquid contains at least one of a fixing reaction promoting agent and a permeation retarding agent.

8. The liquid droplet ejection head as defined in claim 7, wherein, of the first nozzle and the second nozzle which are disposed in a mutually proximate arrangement, the first nozzle is disposed on a downstream side and the second nozzle is disposed on an upstream side in the relative movement direction of the ejection receiving medium with respect to the liquid droplet ejection head.

9. The liquid droplet ejection head as defined in claim 1, wherein the second nozzles are arranged in fewer number than the first nozzles, at a prescribed ratio with respect to the first nozzles.

10. The liquid droplet ejection head as defined in claim 9, wherein a diameter of a dot formed by the droplet of the second liquid ejected from the second nozzle and deposited on the ejection receiving medium is set to a value whereby the dot has a surface area covering a region of a plurality of dots formed by the droplets of the first liquid which are ejected from the first nozzles that are mutually adjacent in a main scanning direction perpendicular to the relative movement direction of the ejection receiving medium and the liquid droplet ejection head, and deposited adjacently on the ejection receiving medium in an alignment in the main scanning direction.

11. The liquid droplet ejection head as defined in claim 10, wherein a second nozzle inclination angle which defines a direction of ejection of the second liquid from the second nozzles is set in such a manner that the droplet of the second liquid ejected from the second nozzle is deposited in an approximately central position between two dots which are formed by two droplets of the first liquid ejected from the first nozzles that are mutually adjacent in the main scanning direction, and deposited adjacently on the ejection receiving medium in an alignment in the main scanning direction.

12. The liquid droplet ejection head as defined in claim 10, wherein, within each of the plurality of dot regions, ejection of the droplet from the second nozzle is controlled in such a manner that the dot is formed by the second liquid only in cases where at least one dot is formed by the first nozzle.

13. The liquid droplet ejection head as defined in claim 1, further comprising a mixture preventing device which prevents mixing of the first liquid and the second liquid, the mixture preventing device being arranged on an ejection surface on which the first nozzles and the second nozzles are formed, between the first nozzles and the second nozzles.

14. An image forming apparatus, comprising:

the liquid droplet ejection head as defined in claim 1;

a first liquid supply device which supplies the first liquid to the liquid droplet ejection head;

a second liquid supply device which supplies the second liquid to the liquid droplet ejection head;

a conveyance device which performs a relative movement of the liquid droplet ejection head and the ejection receiving medium, by conveying at least one of the liquid droplet ejection head and the ejection receiving medium in a specified direction; and a droplet ejection control device which achieves a desired dot arrangement on the ejection receiving medium by causing the first and second liquids to be ejected from the liquid droplet ejection head toward the ejection receiving medium, in conjunction with the relative movement caused by the conveyance device, wherein an image is formed on the ejection receiving medium by means of droplets of the first and second liquids ejected from the first and second nozzles.

* * * * *